US010711539B1

(12) United States Patent
Nolan et al.

(10) Patent No.: US 10,711,539 B1
(45) Date of Patent: Jul. 14, 2020

(54) MODULAR DRILLING RIG HAVING PIPE LIFTING CAPABILITY AND VENTILATION THEREIN

(71) Applicants: David Nolan, Buna, TX (US); Paul M. O'Connor, Sewickley, PA (US)

(72) Inventors: David Nolan, Buna, TX (US); Paul M. O'Connor, Sewickley, PA (US)

( * ) Notice: Subject to any disclaimer, the term of this patent is extended or adjusted under 35 U.S.C. 154(b) by 802 days.

(21) Appl. No.: 14/975,124

(22) Filed: Dec. 18, 2015

Related U.S. Application Data

(63) Continuation-in-part of application No. 13/085,977, filed on Apr. 13, 2011, now abandoned.

(51) Int. Cl.
*E21B 19/15* (2006.01)
*E04B 1/348* (2006.01)
*F24F 7/00* (2006.01)

(52) U.S. Cl.
CPC ..... *E21B 19/155* (2013.01); *E04B 1/34869* (2013.01); *F24F 7/00* (2013.01); *F24F 2007/004* (2013.01)

(58) Field of Classification Search
CPC ... E21B 7/02; E21B 7/028; E21B 5/00; E21B 9/24; E21B 19/155; E21B 16/00
See application file for complete search history.

(56) References Cited

U.S. PATENT DOCUMENTS 2,534,682 A * 12/1950 Robishaw ..... E21B 19/14 182/182.1
3,223,150 A 12/1965 Tramontini
4,407,629 A 10/1983 Willis
4,471,587 A 9/1984 Ahmad
4,759,414 A 7/1988 Willis
4,784,527 A 11/1988 Hunter et al.
4,821,816 A 4/1989 Willis
4,899,832 A 2/1990 Beirscheid
5,575,120 A * 11/1996 Handley ..... A47B 87/007 446/124
6,848,515 B2 2/2005 Orr et al.
7,119,308 B2 10/2006 Kopel
7,222,683 B2 5/2007 Folk
7,255,180 B2 8/2007 Beato et al.
7,387,172 B2 6/2008 Vandeligt et al.
7,469,754 B2 12/2008 Landry
2005/0241823 A1* 11/2005 Beato ..... E21B 7/02 166/243
2008/0104965 A1 5/2008 Petratos
2008/0253866 A1* 10/2008 Lops ..... E21B 19/155 414/22.55
2010/0012737 A1 1/2010 Kates
2012/0097454 A1 4/2012 Kockeis

* cited by examiner

*Primary Examiner* — Caroline N Butcher
(74) *Attorney, Agent, or Firm* — Egbert, McDaniel & Swartz, PLLC

(57) ABSTRACT

A drilling system for use at a wellhead has a plurality of modules each containing rig component equipment. The plurality of modules are connected or interconnected together so as to form a drilling rig. Each of the plurality of modules has a size adapted to be lifted by forklift or a front end loader. The plurality of modules are arranged such that one end of the plurality of modules is adjacent to the wellhead. A pipe handling system is positioned adjacent to one end of the plurality of modules. A ventilation system is cooperative with the plurality of modules so as to move air toward or away from heat-generating equipment in the plurality of modules.

16 Claims, 16 Drawing Sheets

MODULAR DRILLING RIG HAVING PIPE LIFTING CAPABILITY AND VENTILATION THEREIN

CROSS-REFERENCE TO RELATED APPLICATIONS

The present application is a continuation-in-part of U.S. patent application Ser. No. 13/085,977, filed on Apr. 13, 2011, and entitled "Energy Efficient Modular Drilling Rig", presently pending.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to drilling rigs. The present invention also relates to drilling rigs that have modular rig components. The present invention further relates to drilling rigs that have a pipe handling capability. The present invention also relates to modular drilling rigs that have energy-efficient ventilation therein.

2. Description of Related Art Including Information Disclosed Under 37 CFR 1.97 and 37 CFR 1.98

Recently, large areas of energy reserves have been found in numerous land formation throughout the United States. Oil and gas companies are seizing the opportunity to develop these large areas of energy reserve. The oil and gas companies often extract energy reserves from land formations using drilling rigs. The drilling rigs consist of sub-parts made of a mast, a sub-structure, a traveling block, a swivel, a top drive, mud pumps, mud pits, mud cleaning equipment, engines, generators, blowout preventors (BOPs), and other associated equipment which are assembled to make a complete drilling unit. The sub-parts of a drilling rig are typically transported to a drilling location by transport trucks and by oil field flat-bed trucks. The sub-parts are assembled, disassembled, rigged up and rigged down with gin pole trucks, oil field flat-bed trucks, oil field trucks using ramps, trucks using spreader beams, and a variety of cranes. The current drilling-rig fleet, for the most part, has drilling equipment that is forty years old. The fleet uses antiquated drilling systems which are not environmentally-friendly and not suitable for drilling wells in the newly discovered land formations. Thus, there is need for a drilling rig that uses modern drilling equipment and drilling systems that are environmental-friendly and suitable for drilling oil and gas wells in the newly discovered land formations.

The newly discovered land formations require the drilling of multiple wells so as to reach all of the energy reserves. Drilling wells in multiple drilling locations is cost prohibitive in the current economic environment for oil and gas companies. Therefore, there is a need for a drilling rig that can drill multiple wells, both vertical and horizontal, from one drilling location.

Another problem associated with drilling oil and gas wells in the new-found energy reserves is that government regulations now require oil and gas companies to reduce the footprint of the drilling rig and to completely cease using earth pits. Thus, there is a need for a drilling rig design that has a small footprint and reduces the impact of drilling on the environment.

Today, major oil and gas operating companies are focusing on how to improve the safety aspect of rig personnel, equipment, and the associated environment, at the same time improving the drilling and rig moving efficiencies, while lowering the associated costs. Oil and gas operators are asking its drilling contractors to eliminate areas in the drilling and moving operations that have a high accident incident rate by removing these areas, or employing robotics to replace staff or equipment involved in these operational areas.

Currently, onshore drilling machine or drilling rigs main structures, packages or modules are unloaded, assembled, disassembled and loaded directly. This is carried out by using cranes, jin pole trucks, ramps, tail boarding, winches, trailering in place, and/or using self-erecting structures. Also today, forklifts and front end loaders are used in drilling operations during rig-up and rig-down operations to move small pieces of equipment, parts, supplies, racks, associated equipment, drill pipe, casing, and tubulars. These forklifts and front end loaders are not used for major structural components, modules or drilling rig packages.

Currently, the radiator systems in conventional drilling rigs are very inefficient and unproductive. Typically, the rig engine primary radiator system serves to remove heat from the engine fluid cooling system by passing cooled air over the associated engine cooling coils and then passing it into the atmosphere. Additionally, the drawworks associated with drilling rigs can generate a large amount of heat during the tripping of pipe from and to the well. During the production of this heat, cool air is passed over the drawworks so as to remove the heat and they pass the heat into the atmosphere. Currently, drilling rigs do not operate whereby the heat from the engines or the drawworks can be efficiently used for the heating and/or cooling of the rig components.

Current drilling machines or drilling rigs use drill pipe, subs, tubes, rods, drill collars, and casing in drilling and completing wells. These various components are stored on the ground level or in the drilling mast or derrick. These drill pipes, subs, tubes, rods, the drill collars and casing are moved to and from the horizontal ground level by winches, cables, catwalk systems, pipe booms or pipe racking systems to and from the rig floor or into or out of the vertical drill string in the mast.

There are a number of rigs operating today that use a single joint pipe boom or pipe racking system, which are produced by rig manufacturers. None of these pipe boom or pipe racking systems can move tubulars having a length of between two feet and ninety feet to and from horizontal ground level to the vertical mast position. Many of the major oil and gas companies desire to eliminate the storage of pipes or tubes in the mast or have crews working the rig floor connecting joints because of safety reasons. These are the two areas on the rig that have the highest accident incident rates. Oil and gas operators have tended to use rigs with pipe booms or pipe rack systems so as to eliminate these accident areas. However, existing rigs using single joint systems are too slow and inefficient when drilling or tripping in wells deeper than 7500 feet.

There are two areas of any efficiencies. First, during tripping operations when wells are deeper than 7500 feet, a singles rig using 30 to 45 foot joint systems is inefficient because of the number of single joints it picks up or lays down, and the time it takes to connect or disconnect joints in comparison to a triples rig using 90 foot joints or so-called stands standing in the mast. Secondly, during drilling operations, a singles rig and a triples rig picks up 30 to 45 foot joints off the horizontal ground level so as to be equally efficient. However, a triples rig using 90 foot standing in the mast is two to three times more efficient than a singles rig during drilling operations. As such, it has been desirable to utilize pipe handling systems whereby 90 foot sections of pipe can be effectively handled and moved to the drilling rig. However, in such large pipe racking systems, it is not been possible to easily transport the pipe racking system on the bed of the truck. Since the pipe racking system must have a length to accommodate the 90 foot pipe, the pipe racking system requires specialized trucks and/or trailers in order to effectively move the pipe handling system to the wellhead.

Most all large drilling rig packages or modules must be transported on special trailers or trucks that have special permits to allow these loads to be moved on interstate highways and standard roads at certain times of the day and week. There are many parts of the country where it is necessary to dismantle part or a portion of the non-DOT standard rig module because of the standard road width, length, height, and weight restrictions or limitations of the road structure or layout. To move a complete drilling rig with all of its modules seven days of the week and 24 hours per day on U.S. interstate highways or standard rated roads, a standard truck or truck-and-trailer with its load or rig module must meet federal and state width, length, height and weight DOT requirements. The federal DOT sets minimum and maximum standards on width, length, height, and weight of trucks and trailers with its loads on the interstate highway. The federal DOT standards gives the states latitude in setting their minimum and maximum standards on width, height, length and weight of trucks and trailers providing it does not violate federal DOT standards. For example, the federal DOT standards set the maximum standard load weight of a semi-truck and trailer with its loads at 80,000 pounds, a minimum trailer length at 48 feet while the maximum length is 53 feet as the standard load, plus a minimum width of 8.5 feet for straight trucks or truck-and trailer as a standard load, while some states allow the vehicle to have a width of 9 feet. As such, a need has developed so as to be able to effectively transport drilling equipment on the highways while, at the same time complying with DOT requirements.

Various patents have issued relating to modular drilling rigs. For example, U.S. Pat. No. 4,759,414, issued on Jul. 26, 1988 to Willis, discloses a drilling machine that has a drilling substructure skid which defines two-spaced parallel skid runners and a platform. The platform supports a drawworks mounted on a drawworks skid. A pipe boom is mounted on a pipe boom skid and sized to fit between the skid runners of the drilling substructure skid. The drilling substructure skid supports four legs which, in turn, support a drilling platform with a lower-mast section mounted thereon. The legs are pivotably mounted both at the platform and at the drilling substructure skid. A pair of platform cylinders are provided to raise and lower the drilling platform. Struts extend diagonally between the platform and the substructure skid away from the platform such that the struts do not extend under the platform and obstruct access to the region under the platform.

U.S. Pat. No. 4,784,527, issued on Nov. 15, 1988 to Hunter et al., discloses a modular template for drilling subsea oil and gas wells that has a frame constructed of light-weight tubular steel members, guide rods projecting upwardly from the tubular steel members, a latch mechanism attached to the frame, and well pods received in openings in the frame. The openings are generally rectangular in shape.

U.S. Pat. No. 6,848,515, issued on Feb. 1, 2005 to On et al., discloses a process to transport and assemble a drilling rig substructure. The process includes the steps of transporting a driller side substructure section and an off-driller side substructure section to a rig site. The sections are spaced from and parallel to one other. A center substructure section is transported to the rig site. The center substructure section is moved into a space between the driller side and the off-driller side sections. The center substructure section is thereafter connected to the driller side and to the off driller side subsections. A floor of the driller side substructure and a floor of the off driller side substructure are raised while both are connected to the center substructure section from a transport position to a use position while maintaining the floors parallel to the bases.

U.S. Pat. No. 7,469,754, issued on Dec. 30, 2008 to Landry, discloses rig for drilling wells or holes at virtually any angle. The rig has a trailer-mounted derrick which can be tilted to a desired angle. A top drive unit is slidably mounted within the derrick and a hydraulic jacking apparatus. An automated pipe handling apparatus permits efficient transfer of pipe sections from the derrick to a truck, pipe rack, or other storage facility.

U.S. Pat. No. 7,387,172, issued on Jun. 17, 2008 to Vandeligt et al., discloses an apparatus that is disassembled into several transportable components. The apparatus has a drilling module, a drill support module, a hydraulically-driven track carriage on which the modules are removably mountable, a rotary drill carried on the drilling module, a hydraulic pump operatively connected to the track drive mechanisms, and a primary motor. The track carriages are demountably coupled in tandem by a tri-axially articulated hitch mechanism that incorporates a track steering mechanism. The modules are self-propelled and mounted on tracks.

U.S. Pat. No. 7,255,180, issued on Aug. 14, 2007 to Beato et al., discloses a modular transfigurable drilling rig that has one or more transfigurable containers that form an operational drilling rig. Drilling equipment is placed in the containers. The containers include a first and second load-bearing support, and a load-bearing bottom disposed between the first and second load-bearing supports. The drilling equipment is rotatably attached to the load-bearing supports or the load-bearing bottom. The drilling equipment is disposed within the space between the load-bearing bottom and the load-bearing supports. Connectors are adapted to engage two of the containers together. Piping is adapted to connect the drilling equipment together. Cables provide communication between the drilling equipment, and a power source is connected to the drilling equipment.

U.S. Pat. No. 4,899,832, issued on Feb. 13, 1990 to Beirscheid, illustrates a plurality of modules that are interconnected and combined with trailers aligned side-by-side on the ground level with drilling equipment mounted within each module. This patent is based on combining drilling equipment into massive modules to reduce the number of loads to transport and the number of pieces for crews to connect or assemble. These modules are not suited for stacking because of the trailer wheel arrangement, structural integrity, and extra weight. It would not be realistic for the second module to be mounted on the first module and the third module on the second module. These modules are extremely large and heavy and cannot be transported as a DOT standard load on interstate highways or standard roads for 24 hours a day and 365 days per year. The module loads in this patent require special transportation equipment along with special permits so as to limit the time that the day and week loads can be transported. The modules cannot be broken down or reduced into smaller DOT-compliant loads. For example, this patent shows a pipe storage unit having a structure incorporated on a special trailer, with a pipe moving chain system, a pipe supporting system, pipe separating structures, automatic pipe racking systems, plus 100 strands of 5 inch drill pipe 60 feet long and weighing approximately 22 pounds per foot. This exceeds the DOT standard trailer length and the total combination weight of the load, truck and trailer. This patent utilizes trucks, trailers and structures with winches to move and manipulate loads to assemble and disassemble the drilling rig. The modules are not suitable a standard truckable loads because it is necessary to incorporate everything in large loads or modules to reduce erecting time. The rig in this patent could work in the desert, tantra, or open spaces, but not on interstate highways, mountain roads with tight turns, and with bridges having weight, width or height limits.

U.S. Patent Publication No. 2012/0097454, issued on Apr. 26, 2012 to Kockeis, shows the design of an onshore or offshore drilling machine or drilling rig. This patent has a plurality of interconnected modules or segments in a stacking position where a second module is placed on the first module and a third module is placed on the second modules. The modules are capable of moving in an X-Y horizontal axis. This patent refers to a portion of a drilling rig, which is made up of a superstructure, rig floor, drilling mast, top drive, floor tools and a pipe racking system. The modules are not incorporated with drilling equipment within them into a complete modular drilling unit. This patent is directed toward the automatic drilling and racking system which utilizes drill pipe. This patent mentions the use of a forklift in the onshore operations for just loading and unloading the drill pipe into the racking system on the ground. The offshore application uses a crane to carry out the same actions.

U.S. Pat. No. 7,222,683, issued on May 29, 2007 to Folk, pertains to a house or a container for the storage, movement in support of a top drive unit system. The top drive unit system, along with its related attachments, associated parts, and supporting equipment are designed and built to be moved with a forklift. The top drive slides, rails and skids involved in this operation are moved with a forklift. There is a small skid that sits on top of the house which holds hoses, services loops, and parts directly associated with the top drive unit. The parts skid can be moved by forklift or front end loader and can also be performed by a crane. However, it does not describe how the house, container, or rig package can be moved by forklift or a front end loader.

U.S. Pat. No. 4,471,587, issued on Sep. 18, 1984 to Ahmad, describes a dual swing-up superstructure known as a "Sling Shot". It has a substructure composed of two main substructures with many crossbeam members connecting the two subs to form a rig floor. Each substructure in unison is raised by using a cable block and tackle system pulled by a winch in each sub.

U.S. Pat. No. 6,848,515, issued on Feb. 1, 2005 to On, utilizes this "Sling Shot" concept and replaces the cable raising system with a hydraulic cylinder to lift each of the two structures, plus makes the many floor members into one solid rig floor structural module truckable load to connect the two subs together.

U.S. Pat. No. 3,223,150, issued on Dec. 14, 1965 to Tramontini, teaches a two-part heating system that heats a passenger vehicle compartment. The system uses waste heat off the engine exhaust system. When the engine reaches its normal operating temperature, it switches to its secondary fluid heat system, which captures heat from the engine cooling fluid system. This patent does not utilize the primary radiator system to heat the passenger compartment or have the ability to bring in fresh atmospheric air into the compartment.

U.S. Patent Application Publication No. 2010/0012737, issued on Jan. 21, 2010 to Kates, describes a vent system to convert a home or commercial HVAC system from a non-zone to a zone system. The system does not direct forced air in different directions, but stops air from entering a room or internal module. The system is designed to control temperature and humidity by having a uniform temperature throughout a house or building. This is an inside system and does not combine outside-to-outside, or outside-to-inside, or inside-to-outside systems.

U.S. Pat. No. 7,119,308, issued on Oct. 10, 2006 to Kopel, teaches a control for an electrical forced air heater in a home or commercial HVAC system. The system has sensors that monitor the incoming and outgoing air at the electrical resistor heater to judge and make the necessary correction for the controller so as to add or reduce energy so temperature and humidity are uniform throughout the HVAC system.

U.S. Patent Application Publication No. 2008/0104965, issued on May 8, 2008 to Petratos, describes an isolated communications shelter using an HVAC system to control the temperature and humidity of the telecommunications equipment in one compartment or module of the shelter, while using an electrical resistor heater to prevent the freezing of batteries in the other compartment or module of the shelter. The compartment separation and different temperature control systems are carried out for economic reasons.

U.S. Pat. No. 4,407,629, issued on Oct. 4, 1983 to Willis, describes a pipe boom that takes a single drill pipe, drill collar, or tube laying horizontal to the ground on a pipe racking system and moves the single pipe, drill collar, or tube to a vertical position in the drilling mast or in-or-out of a drilling string that is used in the mast.

U.S. Pat. No. 4,821,816, issued on Apr. 18, 1989 to Willis, improves on U.S. Pat. No. 4,407,629 and ties it to a complete single joint drilling machine or drilling rig. This patent incorporates the pipe boom system with an automatic horizontal pipe rack manipulating system moving drill pipe, tubes, rods, drill collars, or casing to and from the pipe boom. These combined systems move drill pipe, tubes, rods, drill collars, and casing on pipe racks, and then loads and unloads the drill pipe, drill collar, and tubes off-and-on the pipe boom. Each of these systems utilize single joints that have a length of a maximum of 45 feet.

It is an object of the present invention to provide a drilling system having modules that individually comply with legal load requirements.

It is another object of the present invention to provide a drilling system that uses modules that can be stacked and interconnected to each other.

It is another object of the present invention to provide a drilling system which has more efficient up-and-down time.

It is another object of the present invention to provide a drilling system that consumes less location space.

It is another object of the present invention provide a drilling system that is safer because of less human contact with the various modules.

It is another object of the present invention to provide a drilling system that efficiently uses waste heat from the engines of the drilling systems or for the drawworks of the drilling system.

It is another object of the present invention to provide a drilling system that is able to move pipe joints of up to 90 feet in length.

It is a further object of the present invention to provide a drilling system that automatically moves pipe from a horizontal position to a vertical position.

It is still another object of the present invention provide a drilling system that provides more control of the modules during moves.

It is still another object of the present invention provide a drilling system that affords better control of working environments and temperatures.

It is still a further object of the present invention to provide a drilling system that has lower costs of assembly and disassembly of the drilling rig.

It is still a further object of the present invention to provide a drilling system that is able to use conveniently-available forklifts and front end loaders to assemble the entire drilling system.

It is still a further object of the present invention to provide a drilling system that is more efficient in drilling and tripping at depths of greater than 7500 feet.

These and other objects and advantages of the present invention will become apparent from a reading of the attached specification and appended claims.

BRIEF SUMMARY OF THE INVENTION

The present invention is a drilling system for use at a wellhead. The drilling system includes a plurality of modules each containing rig component equipment. The plurality of modules are connected or interconnected together so as to form a drilling rig. Each of the plurality of modules has a size adapted to be lifted by a forklift or a front end loader. The plurality of modules are arranged such that one end of the plurality of modules is adjacent to the wellhead.

A pipe handling system is positioned adjacent to this one end of the plurality of modules. The pipe handling system includes a pipe rack adapted to receive pipe thereon, and a lifting boom cooperative that the pipe rack and adapted to move the pipe from a horizontal orientation on the pipe rack to a vertical orientation above the wellhead. The pipe rack extends in longitudinal alignment with the plurality of modules. The lifting boom is pivotally mounted with respect to the pipe rack. The lifting boom has clamps thereon adapted to grip the pipe. An actuator is connected to the lifting boom so as to pivot the lifting boom from a horizontal orientation to a vertical orientation. One of the plurality of modules has a mast extending vertically upwardly therefrom. This mast receives the pipe when the pipe is in the vertical orientation. The lifting boom specifically includes a plurality of sections telescopically connected so as to move the lifting boom from a retracted position to an extended position. The extended position is adapted to receive pipe having a length of 90 feet. The retracted position has a length adapted to be transported on the bed of a truck.

A ventilation system is cooperative the plurality of modules so as to move air toward or away from the engine in one of the plurality of modules. The ventilation system selectively opens to the ambient environment exterior of the plurality of modules. The ventilation system selectively vents air from the plurality of modules to the ambient environment. The ventilation system selectively opens so as to draw air from the ambient environment so as to pass into the plurality of modules. The plurality of modules can include a drawworks module. The ventilation system is cooperative with the drawworks module so as to move air toward or away from the drawworks within the module.

The plurality of modules comprises a first array of modules positioned on an underlying surface, a second array of modules positioned on top of the first array of modules, and a third array of modules positioned on top of the second array of modules. Each of the first, second and third arrays of modules have a generally rectangular configuration.

The Section is intended describe, with particularity, the preferred embodiments of the present invention. It is understood that modifications to these preferred embodiments can be made within the scope of the present claims. As such, this Section should not be construed, in any way, as limiting of the broad scope of the present invention. The present invention should only be limited by the following claims and their legal equivalents.

DETAILED DESCRIPTION OF THE INVENTION

Figure 1:
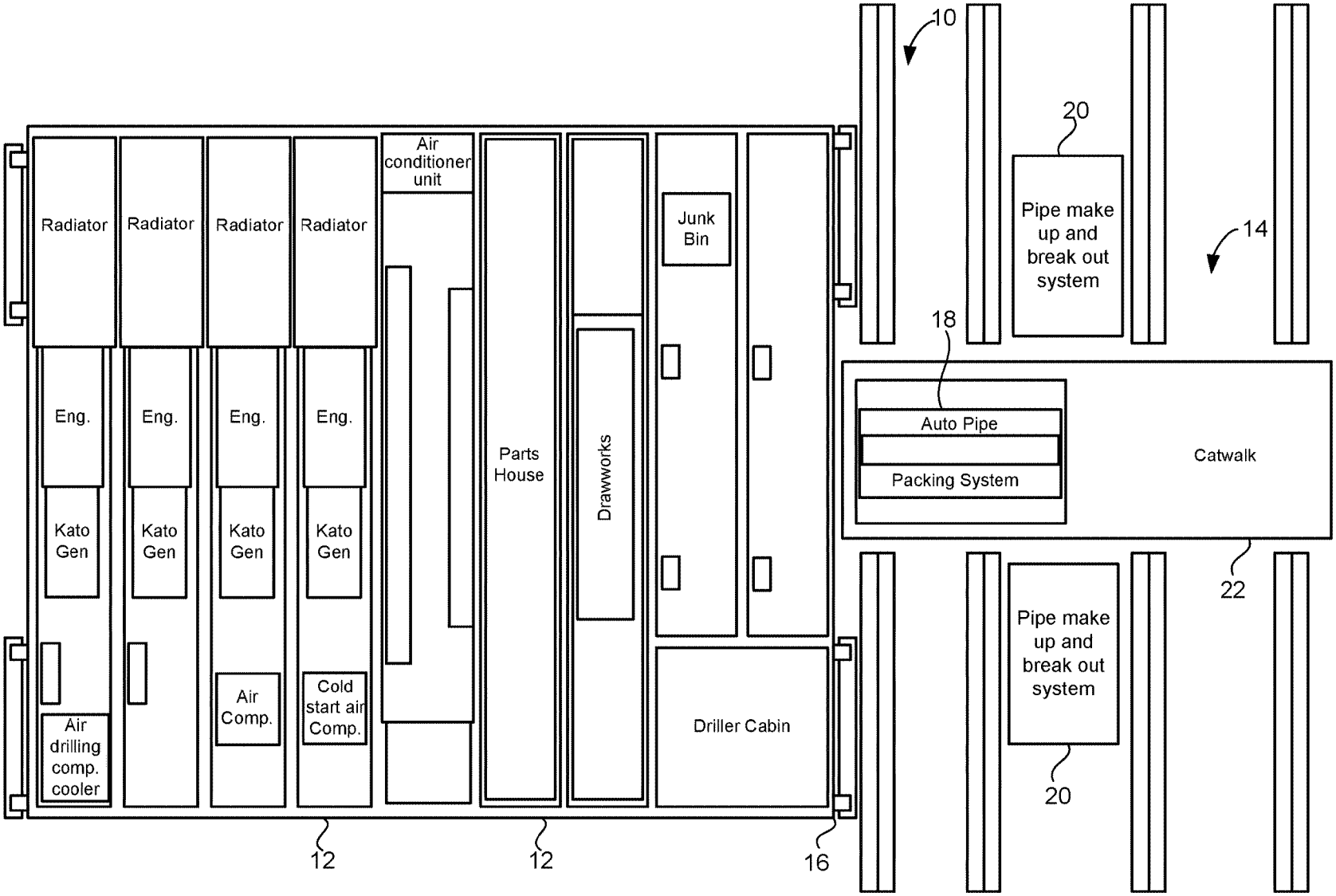
FIG. 1 is a plan view showing the general layout of the drilling system in accordance with the present invention.

Referring to FIG. 1, there is shown the general layout of the drilling system 10 of the present invention. In FIG. 1, it can be seen that there are plurality of modules 12 that are arranged in side-by-side and a stacked arrangement. A pipe handling system 14 is positioned adjacent to an end 16 of the plurality of modules 12. Each of the modules of the plurality of modules 12 has a size that can be manipulated, lifted, or moved by a forklift and/or front end loader. Additionally, each of the modules 12 has a size that can be transported on the bed of a truck or on a trailer. Each of the plurality of modules will have a weight that complies with DOT requirements. Once the plurality of modules are delivered to the drilling location, they can be removed from the bed of the truck by a forklift or front end loader, moved to their desired positions, and then connected or interconnected together. The end 16 of the plurality of modules 14 will be adjacent to the wellhead.

The pipe handling system 14 is arranged so as to generally to arranged adjacent to the end 16 of the plurality of modules 12 and adjacent to the wellhead. The pipe handling system 14 can include a pipe rack 18 for receiving pipe thereon. The pipe rack extends in longitudinal alignment with the plurality of modules 12 and is generally positioned central to a width of the plurality of modules 12. A pipe makeup system 20 is provided on opposite sides of the rack 18 so as to connect and/or disconnect the joints of the pipes together. A catwalk 22 extends outwardly from the pipe rack 18. The pipes can be placed on the pipe rack 18 and connected together so as to have a total length of up to 90 feet. A pipe lifting boom can be provided at the end 16 of the plurality of modules 12 so as to move the pipes on the pipe rack 18 from a horizontal position to a vertical position and to position such pipe directly over the wellhead.

Figure 2:
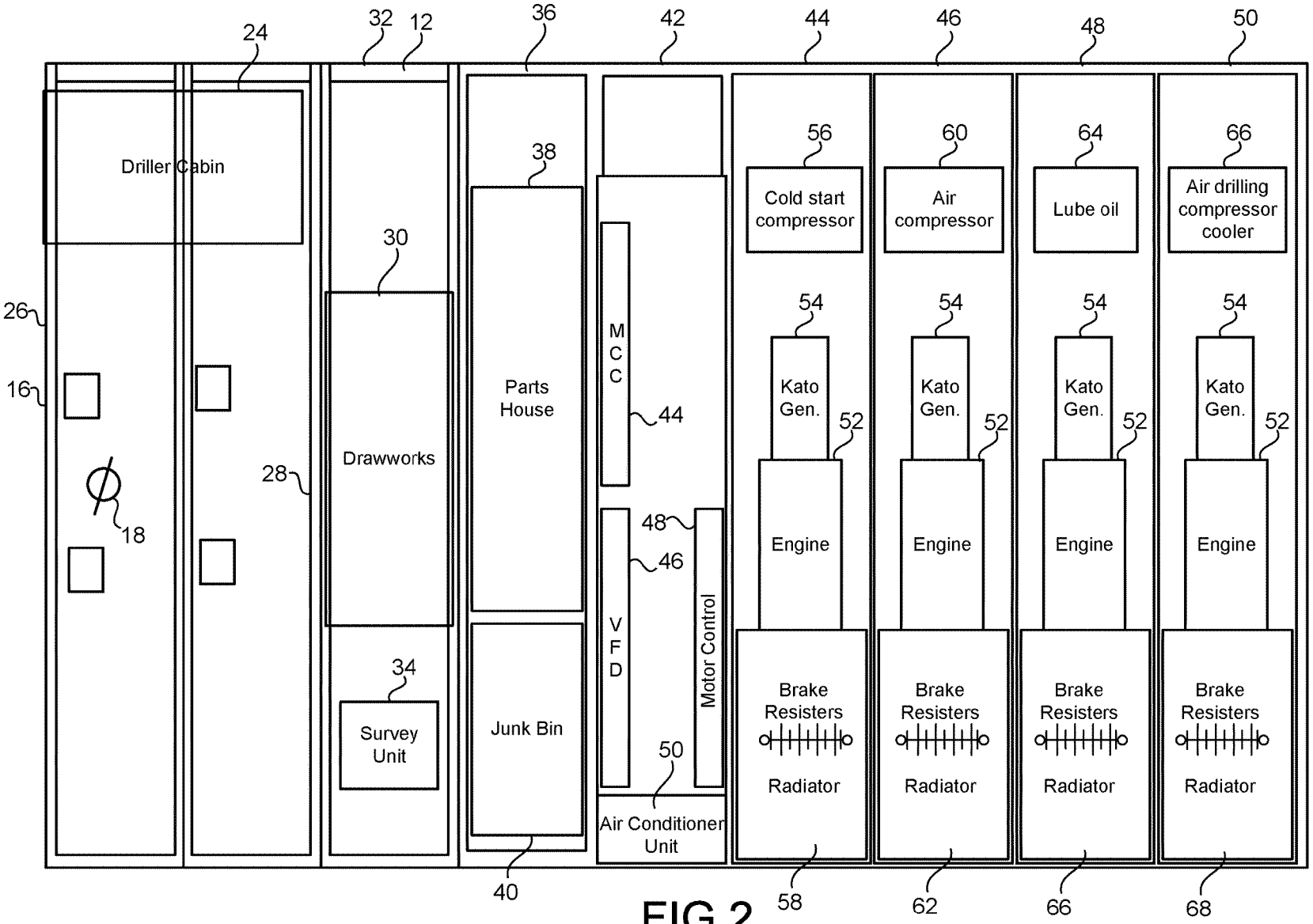
FIG. 2 is a plan view showing the top level of modules of the drilling rig system of the present invention.

FIG. 2 illustrates the top level of the plurality of modules 12. It can be seen that the end 16 of the plurality of modules 12 is positioned adjacent to the wellhead 18. A driller cabin 24 is mounted on modules 26 and 28 so as to be generally adjacent to the equipment at the wellhead 18. A drawworks 30 is positioned on module 32 at one side of modules 26 and 28. Drawworks 30 includes the necessary winch and other equipment for the tripping of the drill pipe. A survey unit 34 is also positioned on module 32. Module 36 includes a parts house 38 and a junk bin 40. Module 42 supports and MCC unit 44 and a variable frequency drive 46. A motor control module 48 is also positioned in module 42. An air conditioner unit 48 is further included in module 42. Modules 44, 46, 48 and 50 include the engines 52 and generators 54. Module 44 includes the cold start compressor 56 and a radiator 58. Module 42 has the air compressor 60 and radiator 62 therein. Module 48 includes the oil reservoir 64 and a radiator 66 therein. Module 50 has the air drilling compressor cooler 66 and radiator 68 therein. The radiators 58, 62, 66 and 68 are cooperative with the engines 52 so as to receive the heat therefrom. Each of the radiators 58, 62, 66 and 68 includes brake registers therein. As such, each of the radiators 58, 62, 66 and 68 serves to dissipate heat produced from the engines 52 and/or the generators 54 within each of the modules 44, 46, 48 and 50. As will be described hereinafter, the ventilation system of the present invention can take this waste heat from the brake registers of the radiators 58, 62, 66 and 68 and use the waste heat for the heating of the interior of the other modules of the drilling system 10. Alternatively, if no heat is required by the other modules of the drilling system 10, the ventilation system of the present invention can release the heat from the brake registers of the radiators 58, 62, 66 and 68 to the ambient environment.

Figure 3:
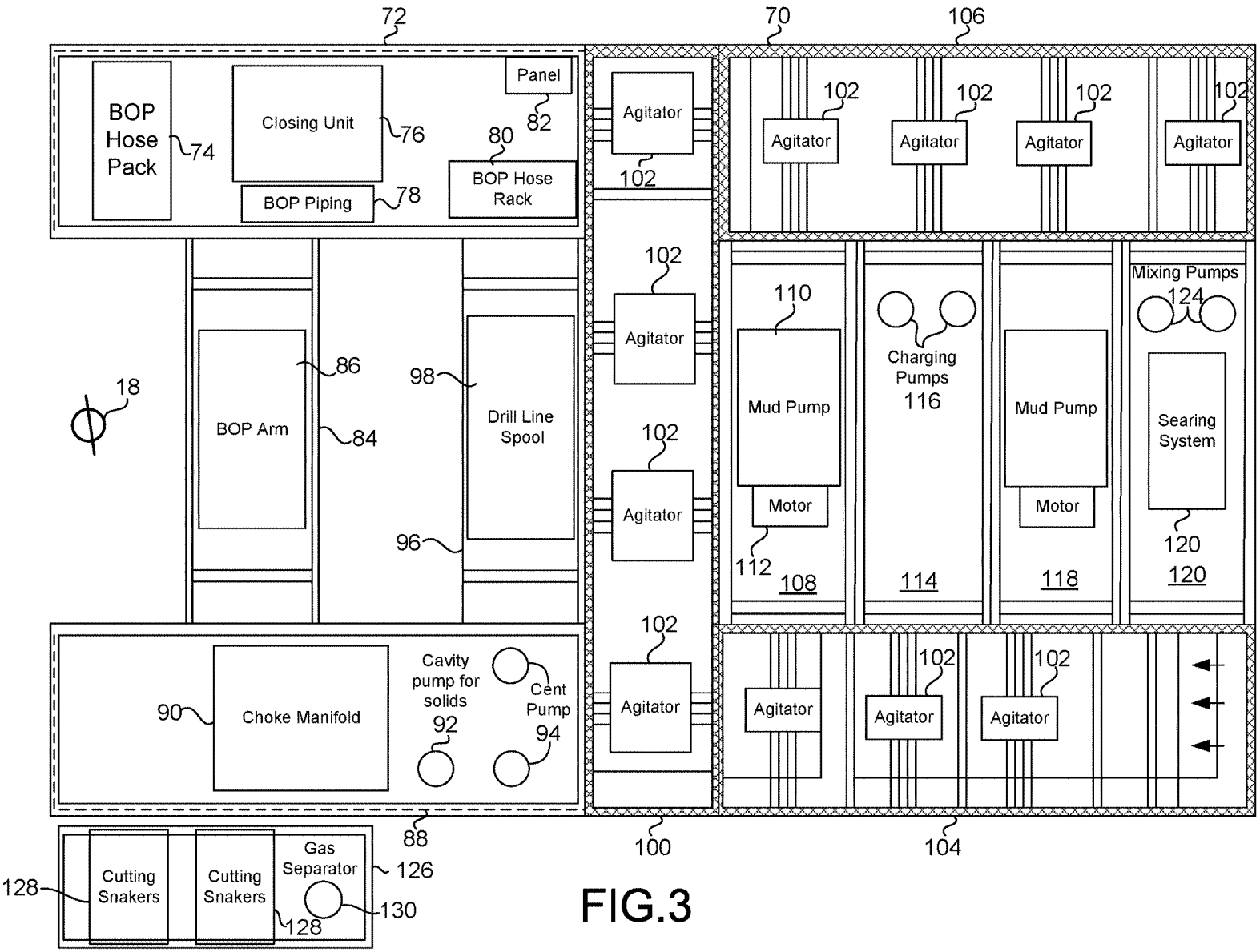
FIG. 3 is an isolated plan view showing the intermediate level of the plurality of modules of the drilling system of the present invention.

FIG. 3 illustrates the second array of module 70 as used in the drilling system 10 of the present invention. A module 72 includes a blowout preventer hose rack 74, a closing unit 76, blowout preventer piping 78, a blowout preventer hose rack 80 and a panel 82. A module 84 will extending transverse relationship to module 84 and is positioned generally adjacent to the wellhead 18. Module 82 includes the blowout preventer arm 86. Module 88 is positioned so as to extend generally longitudinally. Module 88 is positioned at an opposite end of the module 84 from module 72. Module 88 includes the choke manifold 90, the cavity pump for solids 92, and centrifugal pumps 94. Module 96 also extends between modules 72 and 88 and includes the drill line spool 98 which is cooperative with the drawworks 30 (as shown in FIG. 1).

A module 100 extends transverse to modules 72 and 88. Module 100 has agitators 102 therein. Agitators 102 serve to take the drilling mud and agitate the drilling mud for the purposes of mixing. Another module 104 extending in transverse relationship to module 100 also includes further agitators 102 therein. Similarly, module 106 can include agitators 102 therein. The agitators 102 are fluidic ally connected to the drilling system.

A mud pump module 108 having a mud pump 110 and a motor 112 therein is positioned adjacent to the agitator module 100 and between agitator modules 104 and 106. Charging pump module 114, including charging pumps 116, will be positioned adjacent to the mud pump module 108. Another mud pump module 118, including a mud pump and a motor, is positioned on an opposite side of the charging pump module 114 from mud pump module 108. A shearing module 120 is positioned at the end of the second array of modules 70 and between the agitator modules 104 and 106. The shearing module 120 includes a shearing system 122 and mixing pumps 124. A shaker module 126 will be positioned away from the module 88 and fluidically connected to the drilling system. Module 126 includes cutting shakers 128 and gas separator 130.

Figure 4:
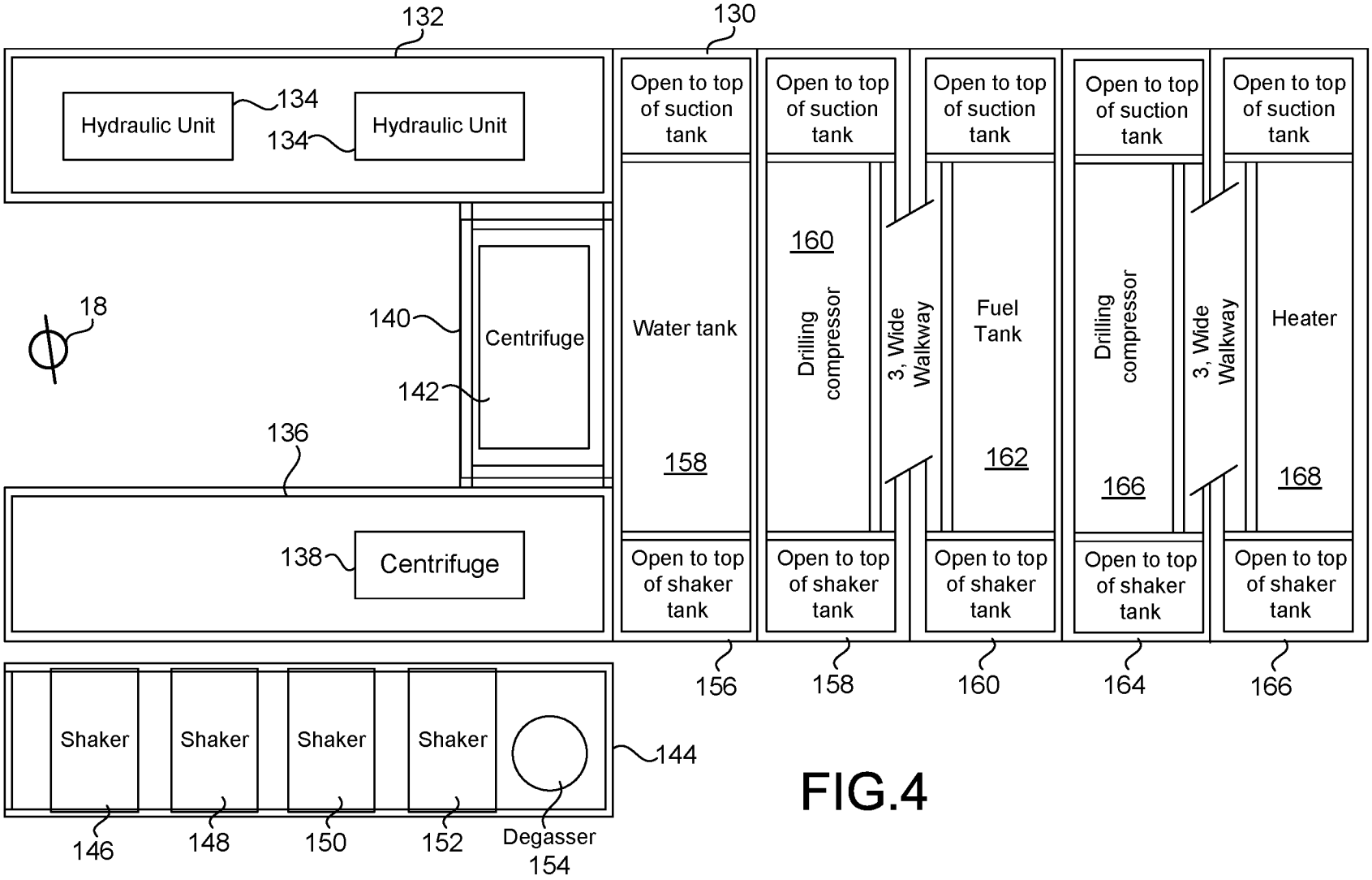
FIG. 4 is an isolated plan view showing the ground level of the plurality of modules of the drilling system of the present invention.

FIG. 4 shows the ground-level array of modules 130. Array 130 includes hydraulic unit module 132 having hydraulic units 134 therein. A centrifuge module 136 is positioned on the opposite sides of the wellhead 18 from the hydraulic module 132. Centrifuge module 136 has a centrifuge 138 for the drilling fluids therein. Another centrifuge module 140 extends between hydraulic unit module 132 and centrifuge module 136 and includes another centrifuge 142 therein. A shaker module 144 is positioned to the side of centrifuge module 136 and include shakers 146, 148 and 150 therein. A mud cleaner 152 and a degasser 154 are also provided in the shaker module 144.

Module 156 includes a water tank 158 therein. The water tank has one end opening to the top of the shaker module 144 and open to the top of the top of the suction tank. Module 158 includes a drilling compressor 160 that opens to the top of the suction tank and opens to the shaker tank. Module 160 has a fuel tank 162 therein. Module 160 opens to the top of the shaker tank and also opens to the top of the suction tank. Module 164 includes the drilling compressor 166. Module 164 is open to the top of the shaker tank and open to the top of the suction tank. Module 166 includes a heater 168 therein. Module 166 opens to the top of the shaker tank and also opens to the top of the suction tank. This ground-level array 130 is the bottom array of the plurality of modules. Intermediate module 70 is positioned on top of the ground-level module 130. The top module (as shown in FIG. 2) will be placed on top of the intermediate array of module 70. In this manner, complete drilling system is provided by the present invention.

Figure 5:
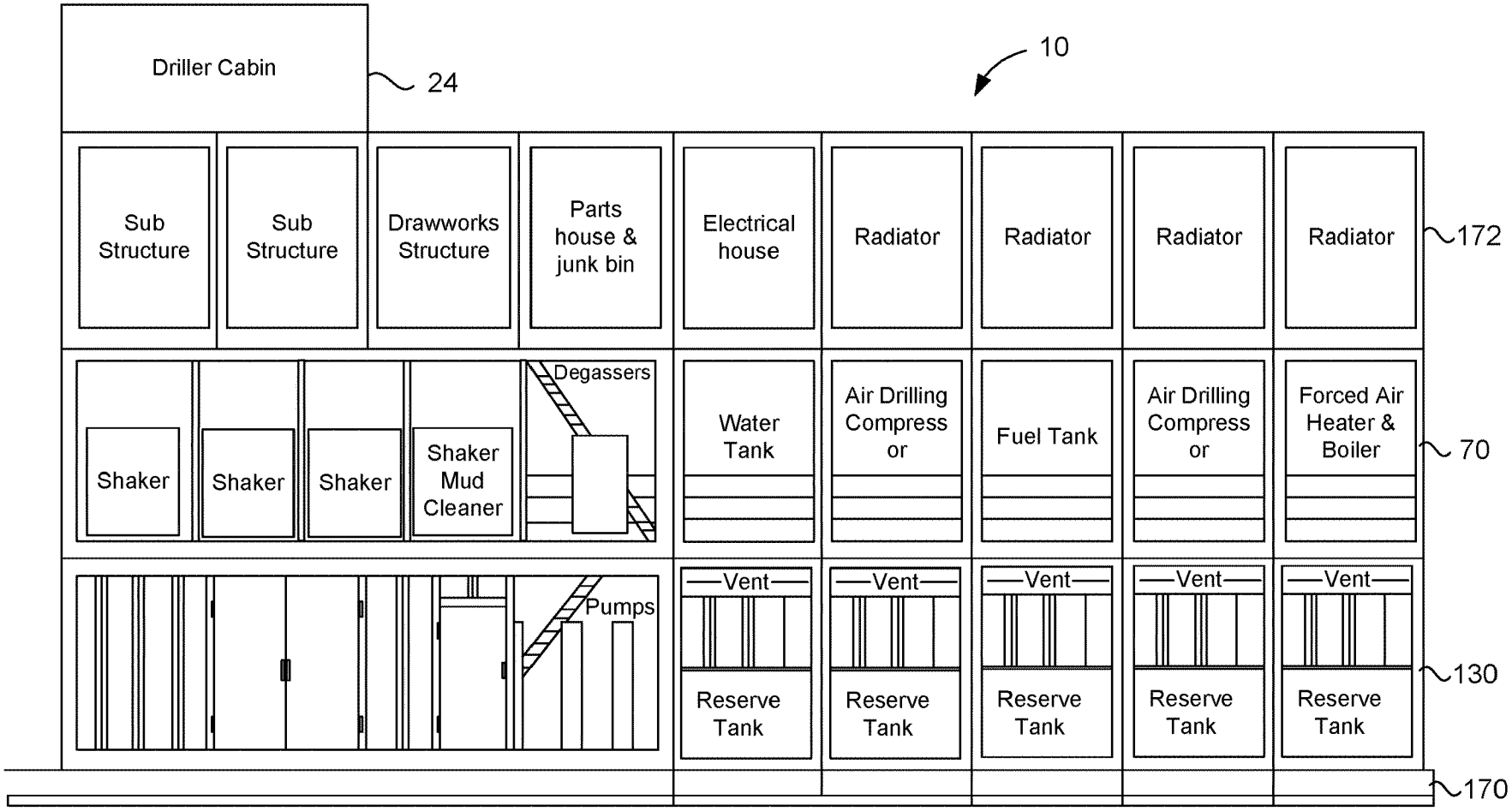
FIG. 5 is a side view of the plurality of modules of the drilling system of the present invention.

FIG. 5 shows the stacked arrangement of modules of the drilling system 10 of the present invention. As can be seen, the ground-level array 130 is supported by an underlying structure 170. Underlying structure 170 can be a skid or rails. Ideally, the ground-level array 130 should be supported above the earth. The intermediate array of modules 70 is positioned on top of the ground-level array of modules 130. The upper array of modules 172 (as shown in FIG. 2) is positioned on top of the intermediate array of module 70. The driller cabin 24 is illustrated as positioned at the top of the upper array of modules 172. Each of the modules 12 in the drilling system 10 of the present invention will be connected or interconnected together so as to cooperatively cause the drilling operation. Each of the array of modules is of a generally rectangular configuration. The end 16 of the drilling system 10 will be positioned adjacent to the wellhead.

Figure 6:
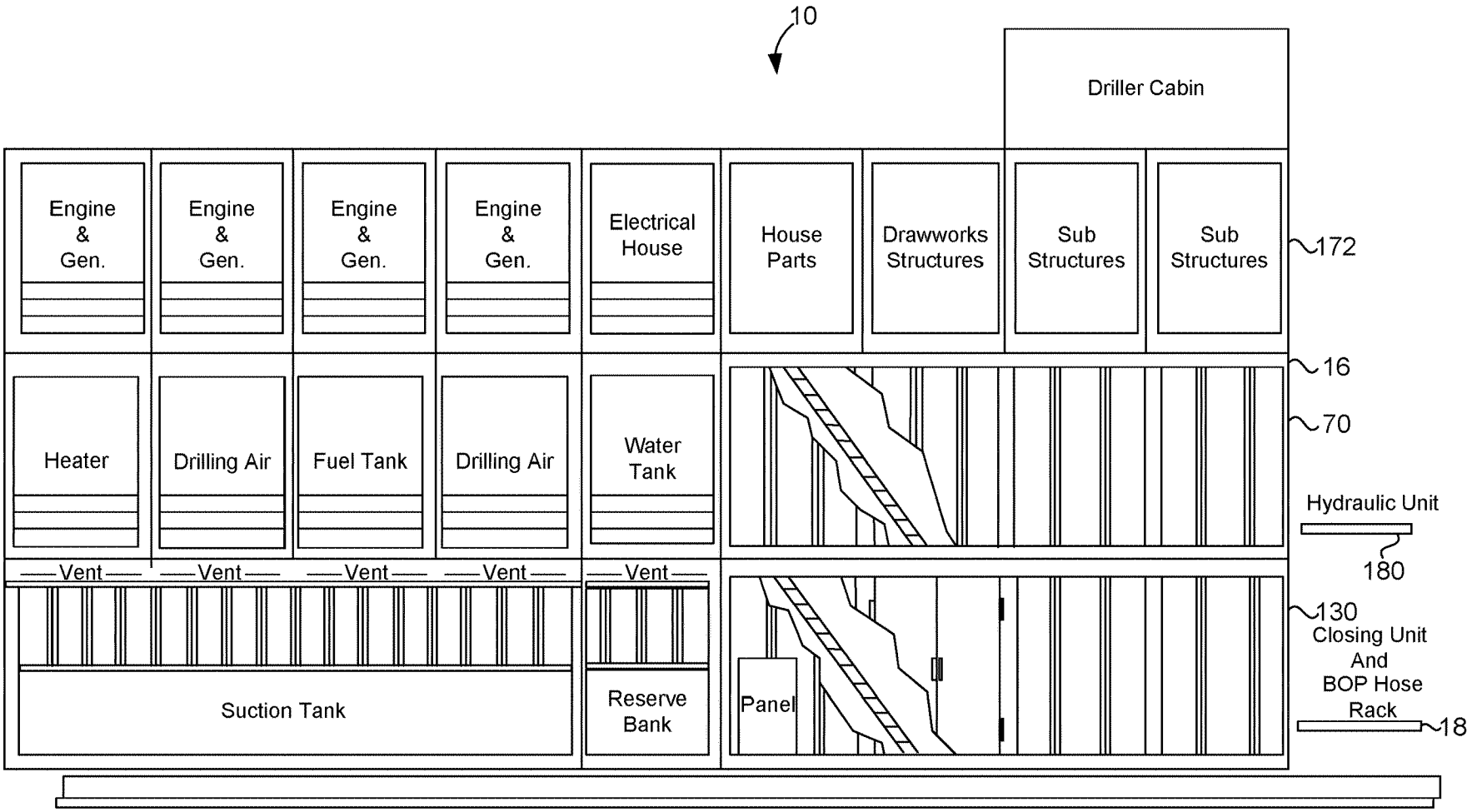
FIG. 6 is an opposite side view of the plurality of modules of the drilling system of the present invention.

FIG. 6 shows an opposite side view of the drilling system 10 of the present invention. As can be seen, the upper array of module 72 is placed upon the intermediate array of modules 70 and upon the ground-level array of modules 130. A portion of the rack 18 is illustrated as positioned adjacent to the end 16 of the system 10. A hydraulic unit 180 serves to deliver hydraulic fluid from the hydraulic pumps within the system 10 to the pipe lifting boom, as will be described hereinafter.

Figure 7:
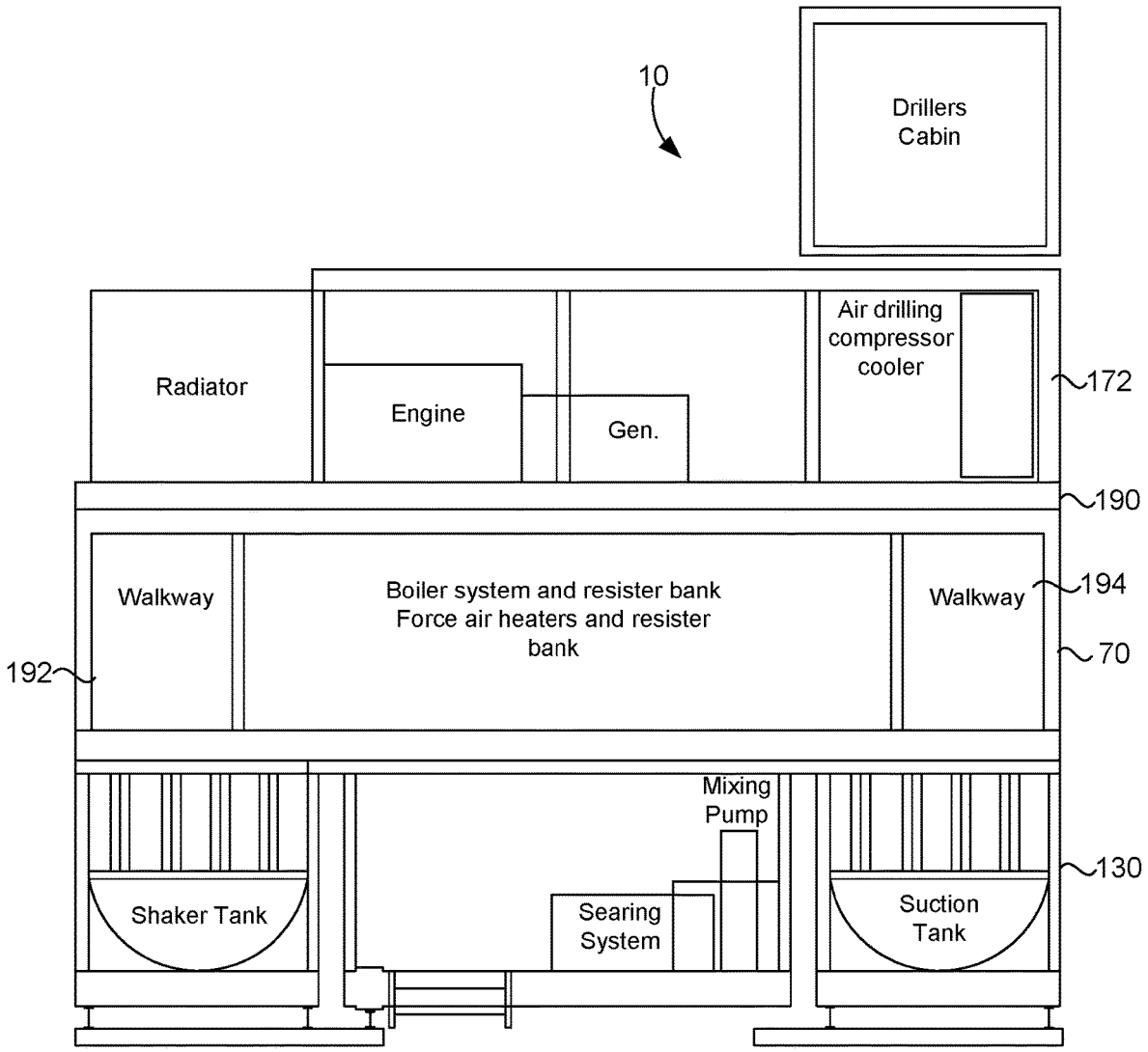
FIG. 7 is one end view of the plurality of modules of the drilling system of the present invention.

FIG. 7 is a view of the end 190 of the drilling system 10 at the opposite end away from the wellhead. As can be seen, the upper array of modules 172 is placed upon the intermediate array of modules 70. The intermediate array of modules 70 is placed upon the ground-level array of modules 130. Walkways 192 and 194 are provided as part of the modules so as to facilitate access to the various equipment within the system 10. Importantly, each of the modules should have a size suitable for transport on highways and in conformance with DOT requirements. Each of the module should have weight of no more than 38,000 pounds. Typically, each of the modules would be of a size of approximately nine feet by nine feet, although certain modules are more elongated. Each of the modules has a weight and a size that can be easily manipulated by a forklift or front end loader. As such, the ground-level array 130 can first be assembled by moving the forklift and the modules in a proper procedure. Then the intermediate level of module 70 can be placed upon the ground-level array 130. Ultimately, the top level of array of modules 172 will be manipulated by the forklift or front end loader so as to reside on the top of the intermediate array of module 70. Importantly, the upper-level array of modules 172 will be a height that is accessible by the forklift.

Figure 8:
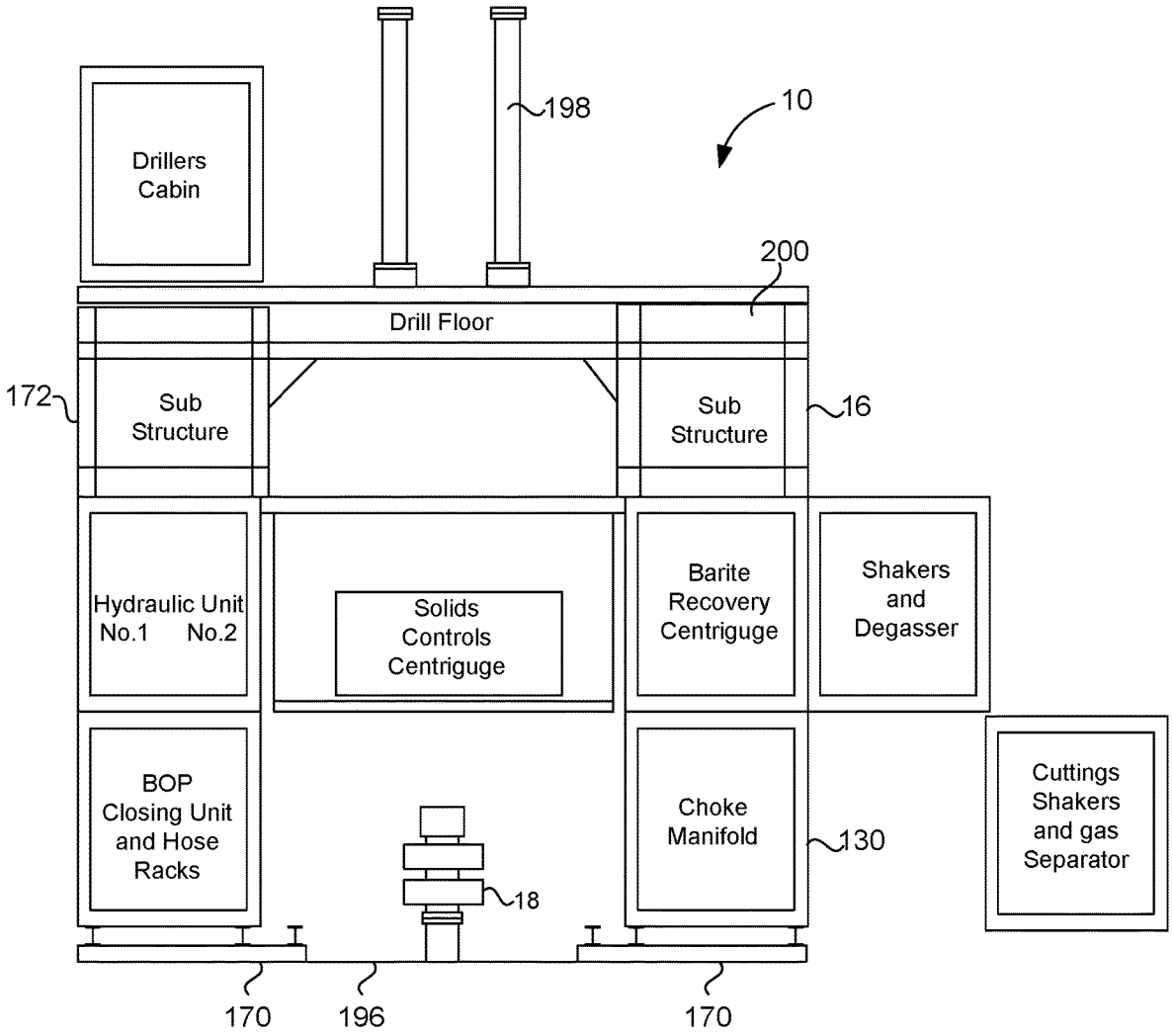
FIG. 8 is an opposite end view of the plurality of modules of the present invention.

FIG. 8 shows the end 16 of the drilling system 10. It can be seen that the wellhead 18 opens at this end 16. The skids 170 are illustrated as supporting the lower level array of modules 130 a distance above the earth 196. The wellhead 18 extends upwardly from the earth 196 into a space formed between the modules of the lower level array of modules. A mast 198 is affixed to the upper array of modules 116 so as to properly support the drill pipe in a position above the wellhead 18. A drill floor 200 is defined above the upper array of modules 172.

Figure 9:
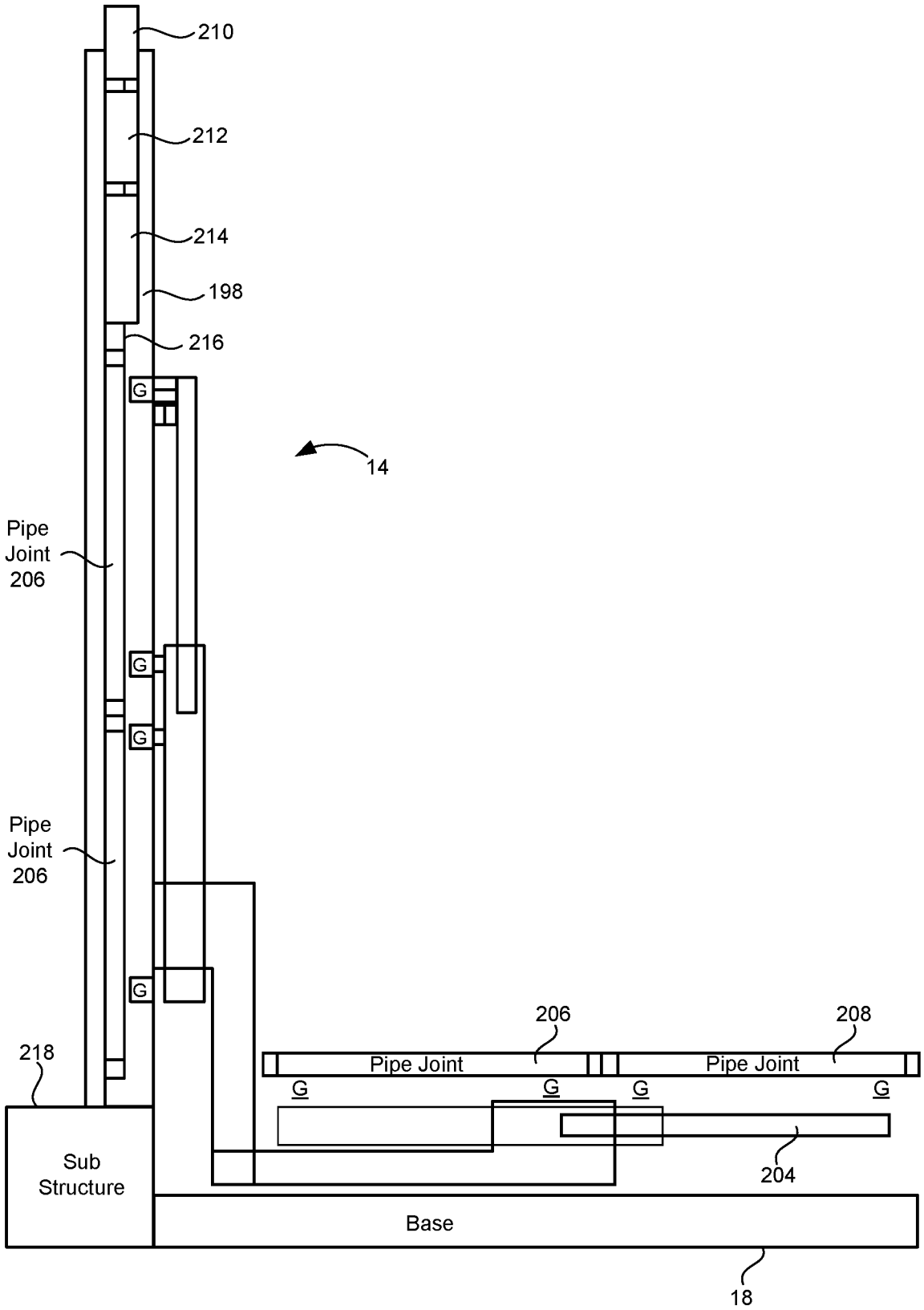
FIG. 9 is a side elevational view of the pipe handling system of the present invention showing the pipe in a horizontal orientation.

FIG. 9 illustrates the pipe lifting system 14 as used in the drilling system 10 of the present invention. The pipe lifting system 10 includes a rack 18 that serves to support a lifting boom 204 thereon. The rack 18 also supports the pipe joints 206 and 208 thereon prior to being placed upon the lifting boom 204. The lifting boom 204 is illustrated as being of a telescopic configuration. As such, so as to accommodate pipe joints 206 and 208 having an extended length of up to 90 feet, the lifting boom 204 can telescope outwardly so as to allow this extended length of pipe to be placed thereon. Initially, the lifting boom 204 will be in a horizontal orientation. An actuator is provided so as to pivot the lifting boom 204 upwardly toward the mast 198. A crown 210 is located at the upper end of the mast 198. A traveling block 212 extends downwardly from the crown 210. A top drive 214 is provided below the traveling block 212. An elevator 216 is located below the top drive 204 so as to receive the end of the upper end of the pipe joints 206 and 208 therein. The pipe joints 206 and 208 are illustrated as joined together during the entire travel from the horizontal orientation to the vertical orientation. In the vertical orientation, the pipe joints 206 and 204 will be in a position directly above the wellhead 18. The mast 198 is supported by the substructure 218.

Figure 10:
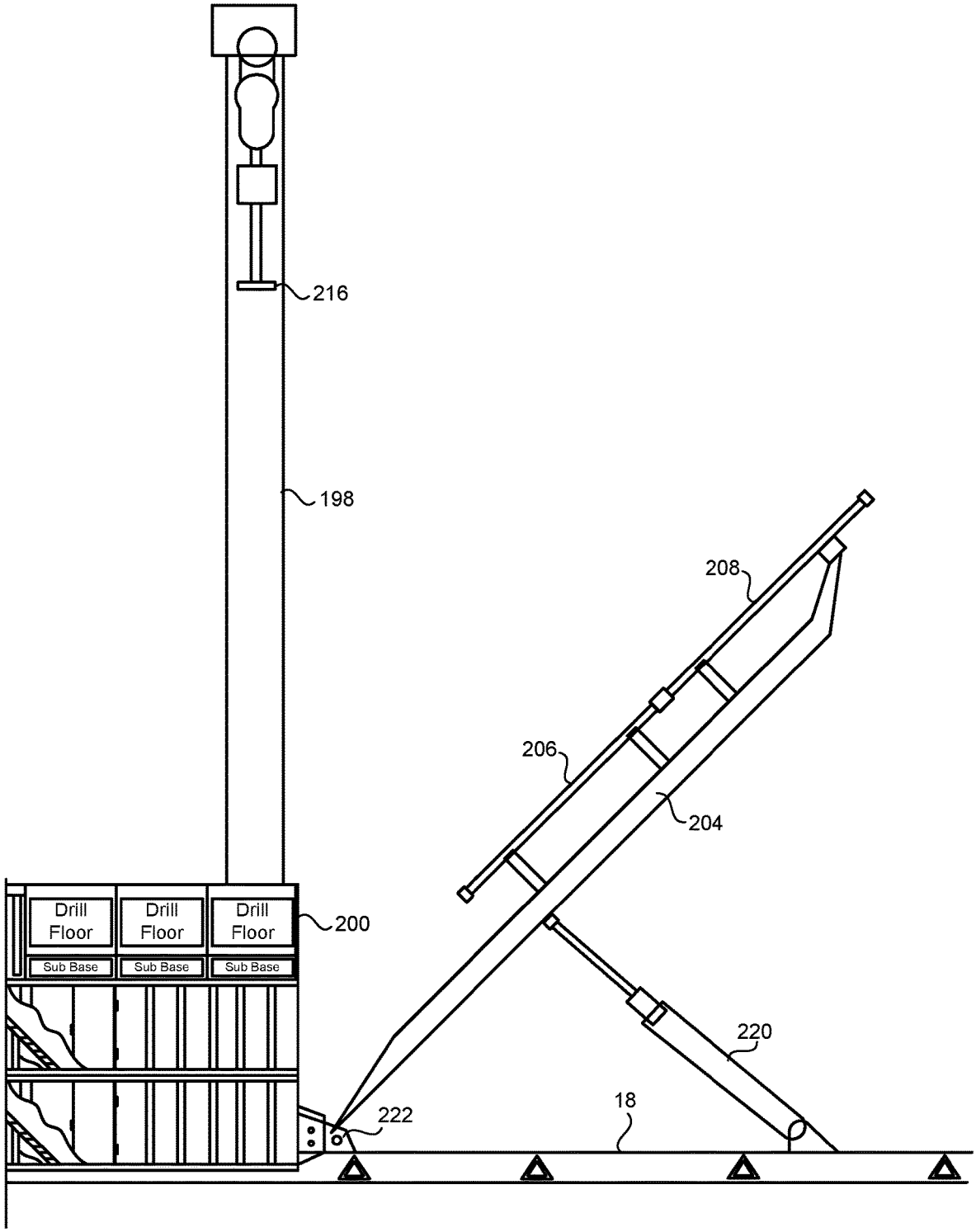
FIG. 10 is a side elevational view of the pipe handling system of the present invention showing the pipe as moving from the horizontal orientation toward the vertical orientation.

FIG. 10 illustrates how the pipe joints 206 and 208 are moved from the horizontal orientation to the vertical orientation. An actuator 220 is provided so as to extend from the rack 18 (or base) toward the middle portion of the lifting boom 204. When actuated, the lifting boom 204 will pivot at pivot pint 222 upwardly toward the mast 198. It can be seen that the mast 198 extends above the drill floor 200 at the upper level of the array of modules. Ultimately, the lifting boom 204 will pivot upwardly until the pipe joints 206 and 208 are located directly above the wellhead 18 and can be received by the elevator 216. A similar procedure is carried out for the removal of the drill pipe during the upward tripping of the drill pipe.

Figure 11:
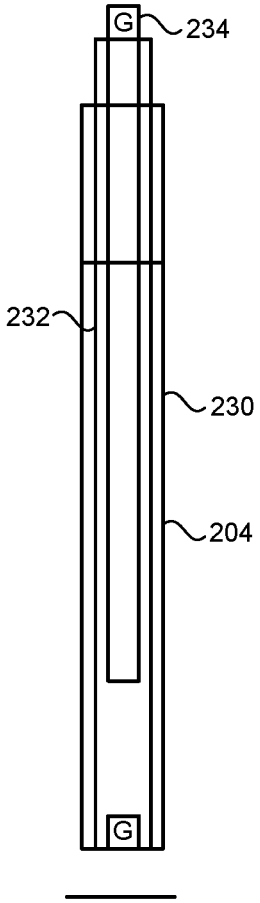
FIG. 11 illustrates the lifting boom of the pipe handling system of the present invention in its retracted position.

FIG. 11 shows the unique arrangement of the lifting boom 204 of the present invention. The lifting boom 204 includes a plurality of sections 230, 232 and 234 that are telescopically connected. In other words, the outer section 230 will overlie the second section 232. The second section 232 will overlie the third section 234. In this retracted configuration, the boom 204 will have a minimal length, in the order of 20 feet. As such, it can be easily transported to the drilling location on the bed of a truck. Additionally, it will have a weight which complies with DOT requirements.

Figure 12:
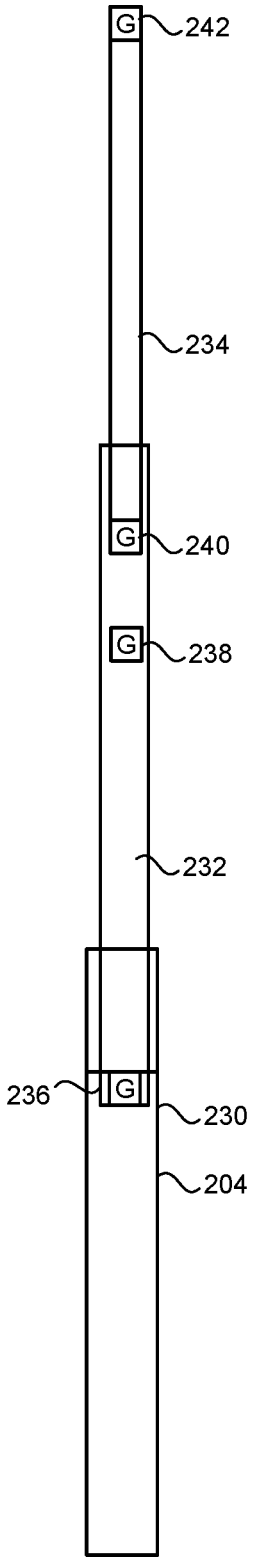
FIG. 12 shows the lifting boom of the pipe handling system of the present invention in its extended position.

FIG. 12 shows the boom 204 in its extended configuration. In particular, the middle section 232 is telescoped outwardly of the outer section 230. The inner section 234 is telescoped outwardly of the middle section 232. Various clamps 236, 238, 240 and 242 are positioned on the boom 204. These clamps 236, 238, 240 and 242 can serve to grasp the pipe therein.

Figure 13:
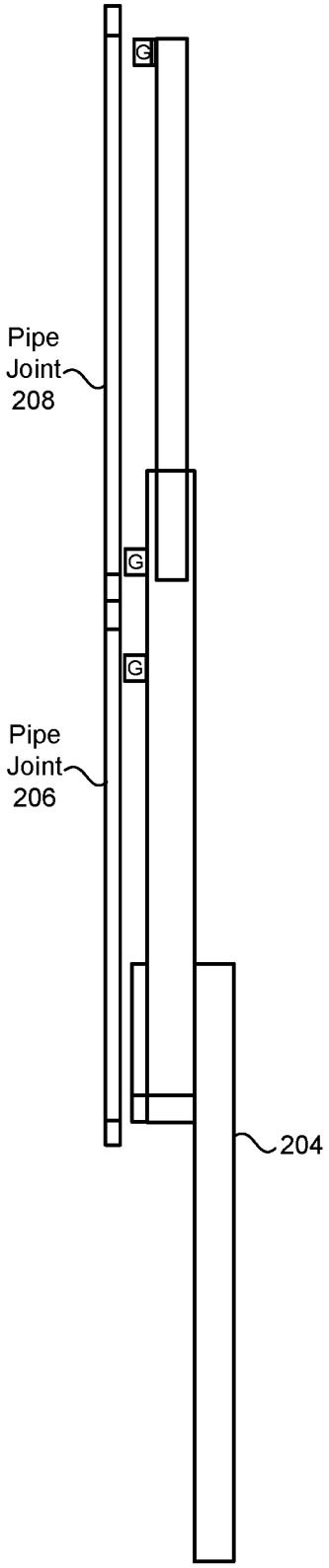
FIG. 13 shows the lifting boom of the pipe handling system of the present invention in its extended position and as used with an extended length of pipe.

FIG. 13 illustrates this extended configuration as grasping the pipe joints 206 and 208. As such, when the boom 204 is telescoped to its extended position, an extended length of pipe can be manipulated. This extended length of pipe can be up to 90 feet.

Figure 14:
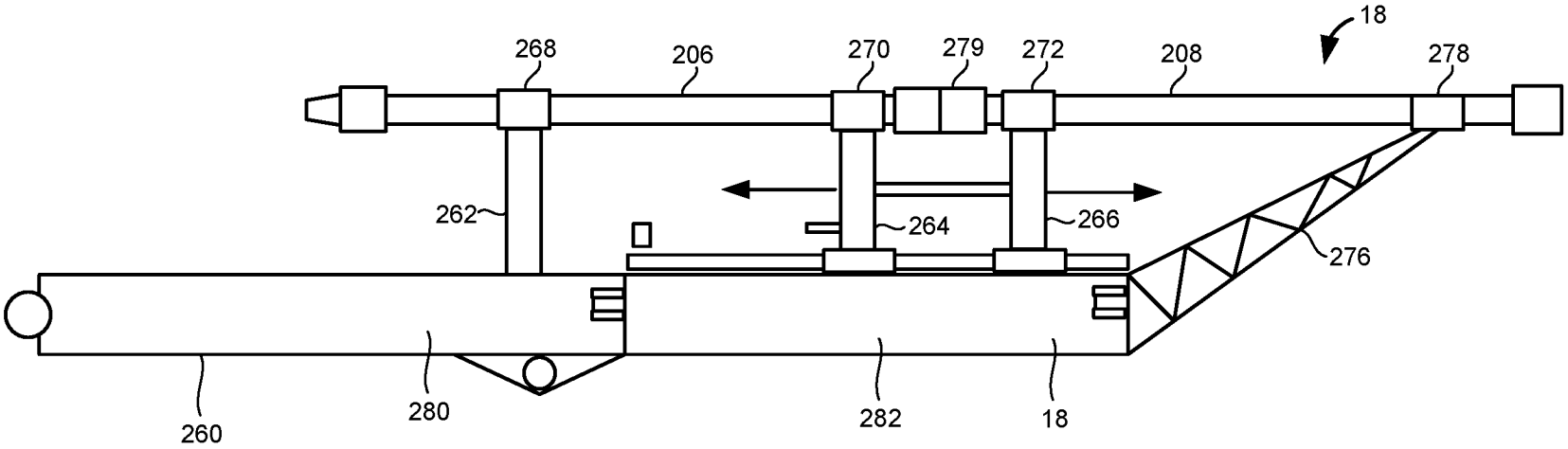
FIG. 14 is a side elevational view of the pipe rack as used in the pipe handling system of the present invention.

FIG. 14 illustrates the configuration of the pipe rack 18 of the present invention. The pipe rack 18 includes a base 260 which is suitable for placement on the earth or other underlying surface. A plurality of supports 262, 264 and 266 extend upwardly from the base 260. The support 262 supports a cradle 268 thereon. Support 264 supports cradle 270 thereon. Support 266 supports cradle 272 thereon. The drill pipe joints 206 and 208 are received within cradles 268, 270 and 272. The cradles 268, 270 and 272 can include suitable spinner mechanisms so that the pipe joint 206 can be locked to the pipe joint 208 at connection 274. An upwardly angularly extending arm 276 extends outwardly from the base 216 so as to support a cradle 278 thereon. Cradle 278 receives the outer end of the pipe joint 208. As such, each of the pipe joints 206 and 208 is supported in spaced relation at two separate locations. The base 260 is also illustrated as being telescopically arranged. A section 280 is telescopically received within another section 282. As such, the rack 18 can be easily transported to the drilling location on the bed of a truck. Ultimately, the rack 18 is manipulated so as to allow the pipe joints 206 and 208 to be delivered to the lifting boom 204.

Figure 15:
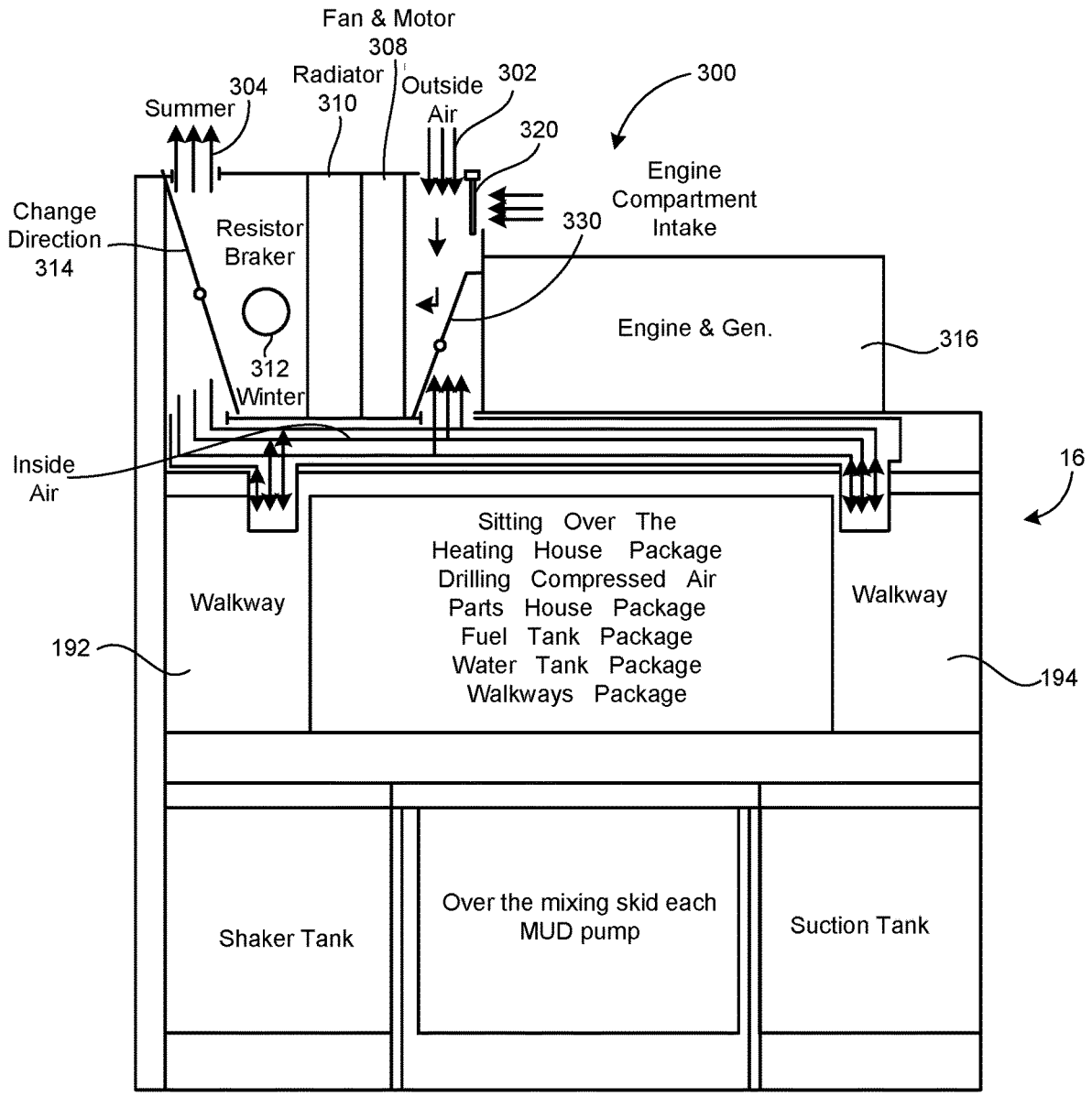
FIG. 15 is a cross-sectional view showing the ventilation system as used in the drilling system of the present invention.

FIG. 15 shows the ventilation system 300 of the present invention. As can be seen, the ventilation system 300 includes an inlet 302 for allowing ambient air from the environment external of the drilling system 16 to enter the drilling system 16. An outlet 304 is provided so as to allow air from the interior of the drilling system 16 to exit the system. In FIG. 15, it can be seen that there is a diverter 306 that is associated with the inlet 302. The diverter 306 is oriented into a position so as to direct the ambient air toward a fan 308 and then through a radiator 310. The heated air from the radiator 310 can then be passed by the braker resistor 312. Another diverter 314 is configured so as to either direct the air passing by the braker resistor 312 back into the interior of the system 16 or outwardly through the outlet 304. In FIG. 15, it can be seen that this diverter 314 serves to direct the heated air toward the walkways 192 and 194. Additionally, this heated air can be directed toward the parts house, the cabin, the fuel tank, and the water tank.

In FIG. 15, the engine generator 316 is positioned adjacent to the inlet 302. The engine generator can receive the air from the interior of the system 16 for the purposes of cooling. The diverter 306 can be manipulated so as to open to the inlet 302 such that, under cold weather conditions, the cool air can be used for cooling the engine and generator 316. This would serve to direct the heat outwardly of the system 16.

Figure 16:
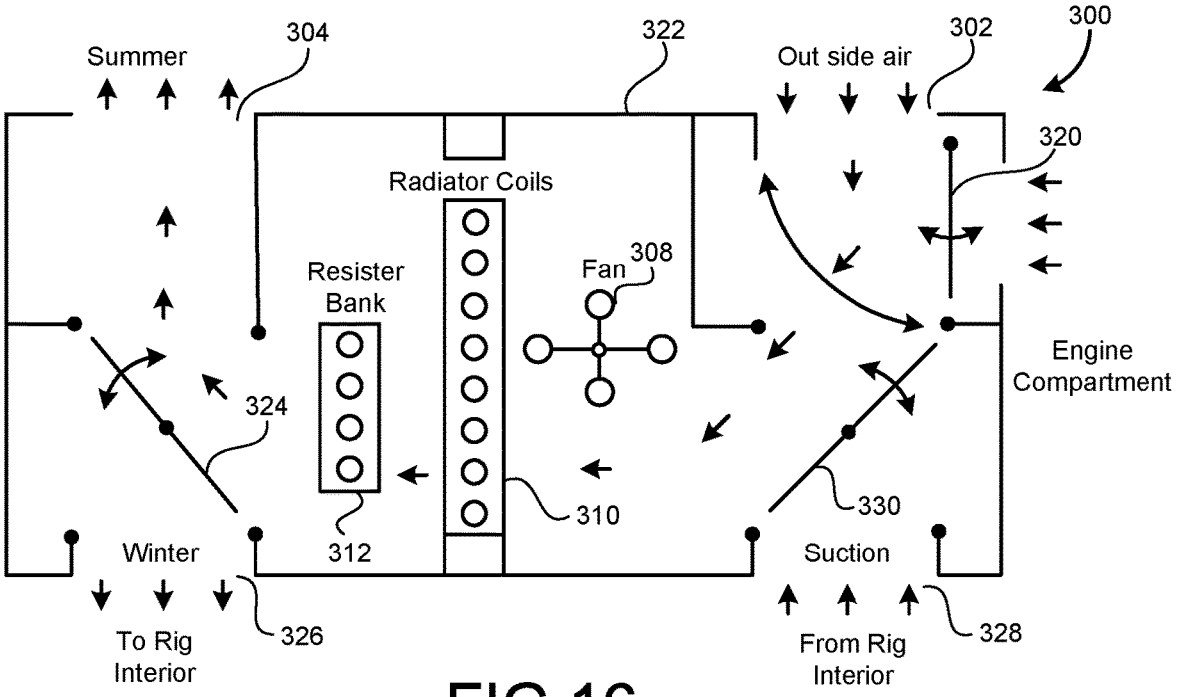
FIG. 16 is a diagrammatic illustration of the ventilation system of the present invention as operating in a summer mode.

FIG. 16 shows the operation of the ventilation system 16 in a summer mode. The inlet 302 is illustrated as drawing ambient air into the interior. The heated air from the engine compartment is blocked by a diverter 320. The ambient air flows through the interior of the housing 322 through the operation of fan 308. As such, this warm ambient air is directed across the radiator 310 and by the breaker resistor 312. Ultimately, this heated air is directed outwardly of outlet 304 by the orientation of the diverter 324. Diverter 324 prevents the heated air from passing through another outlet 326 to the interior of the drilling system. Another inlet 328 is blocked by a diverter 330 from entering the interior of the housing 322.

Figure 17:
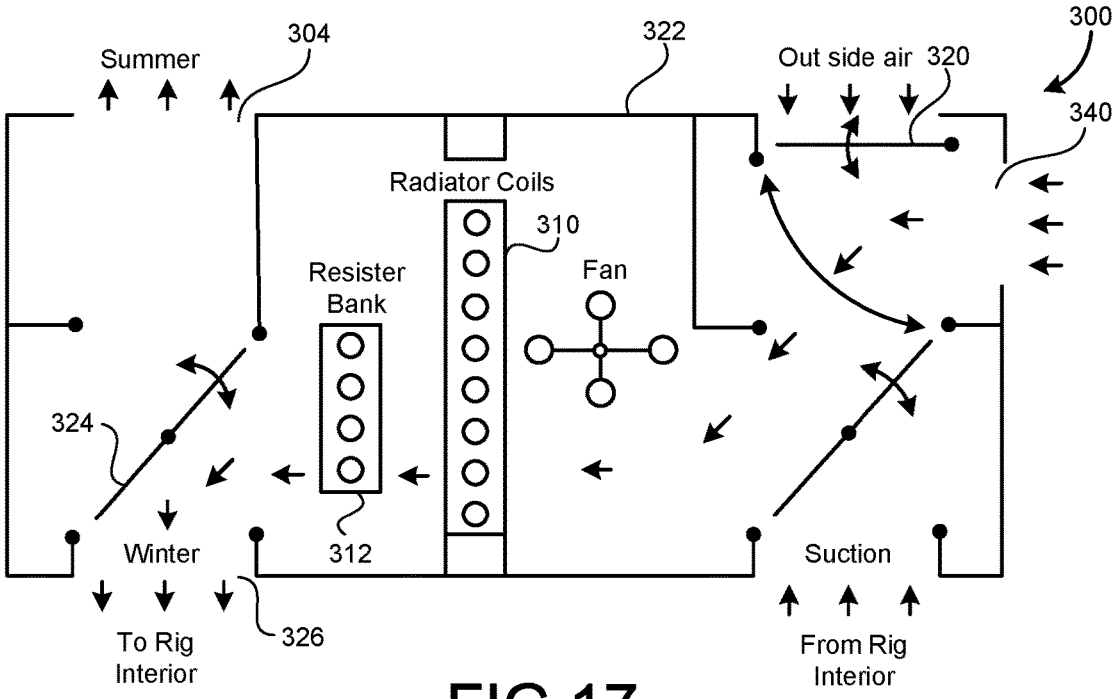
FIG. 17 is a diagrammatic illustration of the ventilation system of the present invention as operating in a winter mode.

FIG. 17 illustrates the ventilation system 300 of the present invention as used in a winter mode. In this mode, the heated air from the engine 316 passes through the opening 340 into the interior of the housing 322. This air is blocked by the diverter 320. As such, this heated air from the engine and generator 316 will pass through the interior of the housing 322 past the radiator 310 and the resistor bank 312 so as to cool the radiator coils of radiator 310 and to be heated by the energy in the resistor bank 312. This heated air will then pass through the outlet 326 into the interior of the drilling system. Diverter 324 is closed so as to prevent this air from exiting outlet 304. As such, this effectively captures the waste heat created by the drawworks and the engine/generators for use in the interior of the drilling system.

Figure 18:
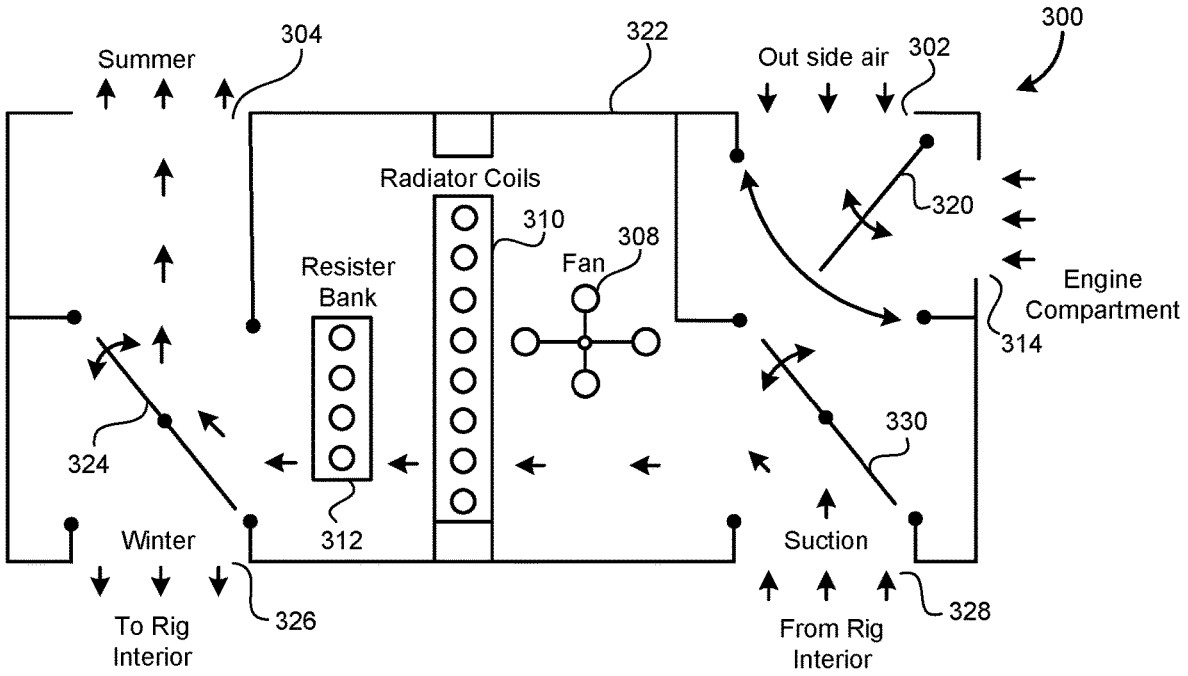
FIG. 18 is a diagrammatic illustration of the ventilation system of the present invention as operating in a suction vent mode from the rigging interior.

FIG. 18 illustrates the ventilation system 300 in a suction vent mode from the rig interior. In this mode, the heated air from the engine and generator 316 is directed through inlet 314. The diverter 320 serves to direct this air into the interior of the housing 322. Additionally, the diverter 330 is oriented so as to cause the air from the interior of the drilling system to pass into the inlet 328 and into the interior of the housing 322. This air from the interior of the drilling system is then directed by fan 308 across the radiator 310 and across the resistor bank 312. This heated air is then directed outwardly through the outlet 304 by the orientation of the diverter 324. This air is prevented from entering the interior of the drilling system through the outlet 326. The entry of both ambient air through the inlet 302 and the entry of heated air from the engine and generator 316 will be blocked by diverter 330 from entering the interior of the drilling system.

Figure 19:
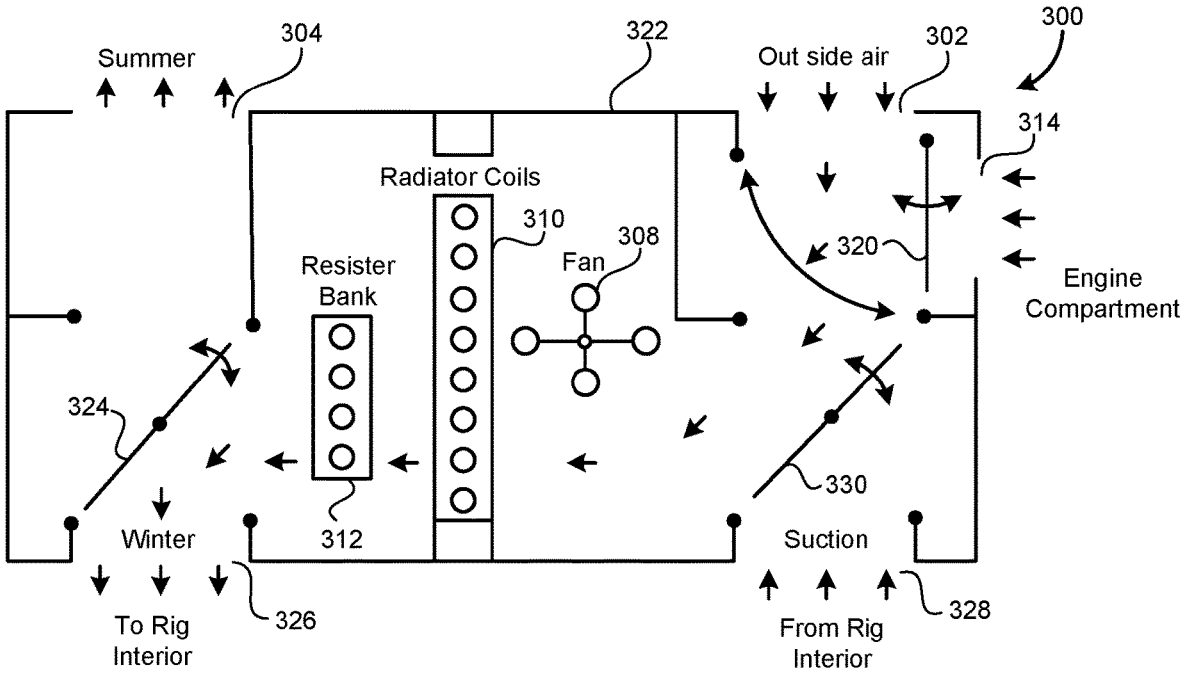
FIG. 19 is a diagrammatic illustration of the ventilation system of the present invention in a fresh air mode into the interior of the drilling rig when the engine and resistor bank are not running.

FIG. 19 shows the ventilation system 300 in a configuration to allow the fresh air from the ambient environment to enter the interior of the drilling system when the engine and resistor bank are not running. As can be seen, the diverter 320 is moved to block air from entering from the engine and generator 316 through the inlet 314. The inlet 302 is opened by diverter 320 so as to be directed into the interior of the housing 322. Diverter 330 serves to block air from the interior of the drilling system from passing into the interior of the housing 322 through the inlet 328. This fresh air then passes by operation of the fan 308 across the non-operating radiator 310 and the non-operating resistor bank 320. This fresh air is then directed through the outlet 326 into the interior of the drilling system by the orientation of the diverter 324.

Figure 20:
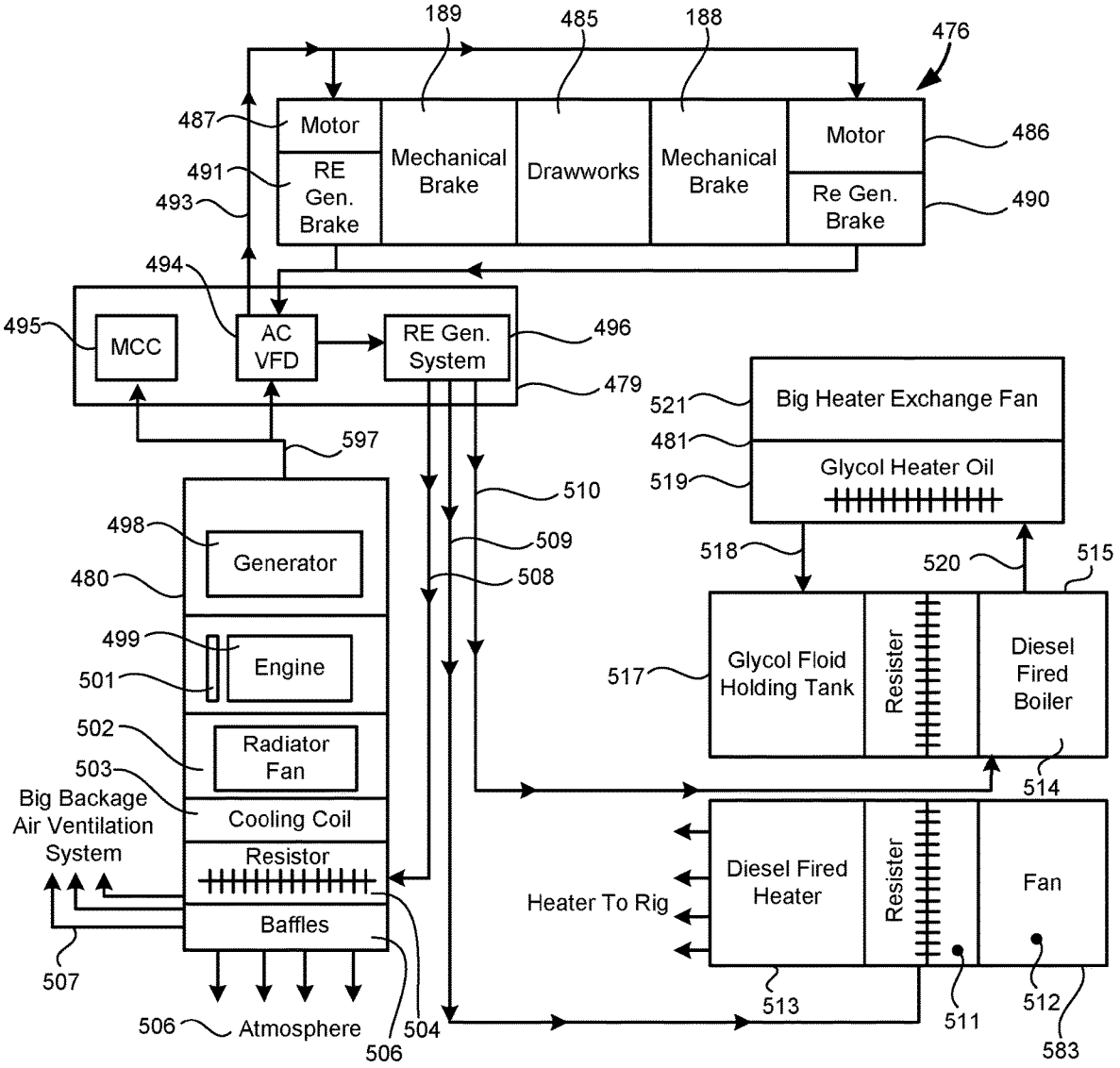
FIG. 20 is a schematic showing the operation of the ventilation system of the present invention.

Referring to FIG. 20, there is shown the ventilation system 476 in accordance with the teachings of the present invention. The ventilation system 476, as shown in FIG. 20 is in its preferred embodiment. There is a drilling unit 478 that is connected to an electrical power house 479. An engine/generator system 480 is electrically cooperative with the electrical power house 479. A first heating system 481 and a second heating system 483 are also electrically cooperative with the electrical power house.

In the present invention, as illustrated in FIG. 20, the ventilation system 478 has the drilling unit 478 particularly illustrated as having a drawworks 485. The drawworks is a system within the drilling unit that causes the drill string to move upwardly and/or downwardly. Energy is consumed whenever it is necessary to pull the drill string, and other equipment, in an upward manner. Whenever the drill string is lowered, a braking action is required so as to prevent a runaway drill string. This will also consume energy. In particular, the drawworks 485 is driven by motors 486 and 487. The motors 486 and 487 are electrical motors. Mechanical brakes 488 and 489 are connected to the shaft between the motors 486 and 487 and the drawworks. The mechanical brakes 488 and 489 serve to mechanically slow the lowering of the drill string by the drawworks 485. Importantly, the motors 486 and 487 are respectively connected to the regeneration brakes 490 and 491. Regeneration brakes 490 and 491 serve to capture the energy during the lowering of the drill string. In other words, instead of dissipating the energy in the form of heat, energy is generated by the braking action during the lowering of the drill string by the drawworks. The energy that is produced by the regeneration brakes 490 and 491 passes along line 492 to the electrical power house 479. Energy for the operations of the motors 486 and 487 is delivered from the electrical power house 479 through line 493. The electrical power house 479 includes an AC variable frequency drive 494, an MCC 495 and a regeneration system 496 therein.

Power is delivered to the variable frequency drive 494 in the electrical power house 479 along line 497 from the generator/engine system 480. The generator/engine system 480 includes a generator 498 and an engine 499 therein. A muffler 501 can be connected to the engine 499, or to the output thereof, so as to minimize noise. The engine will produce energy by rotation action imparted to the generator 498. The engine/generator system 480 also includes a radiator fan 502, a cooling coil 503, a resistor bank 504 and baffles 505. The baffles 505 are illustrated as being suitably manipulatable so as to deliver hot air to the atmosphere 506 and/or to the rig package air ventilation system 507. As such, the generator/engine system 480 is suitable for proving power to the drawworks 485 and also for delivering heat to the rig system.

The recaptured energy from the regeneration brakes 490 and 491 will deliver energy outwardly therefrom along lines 508, 509, and 510. Line 509 utilizes the recaptured energy so as to provide heat to the resistor bank 504 associated with the generator/engine system 480. Line 509 delivers electrical energy to the resistor bank 511. The resistor bank 511 is located is heating system 483. A fan 512 passes forced air through the resistor bank 511 and through the diesel-fired heater 513 so as to provide hot air to the rig in cold weather conditions. The line 510 delivers electrical energy from the regeneration system 496 to a resistor bank 514 located in a ventilation system 515. Ventilation system 515 includes a diesel- or gas-fired boiler 516 and a glycol fluid holding tank 517. As such, the heat from the resistor bank 514 and the diesel- or gas-fired boiler will provide heat to the glycol fluid within the holding tank 517. This glycol fluid can then be passed along piping 518 pass through resistor bank 514 and through the diesel-powered boiler 516 and outwardly therefrom so as to pass through the glycol heater coils. Once the heated glycol fluid is passed in heat exchange relationship through the coils 519, the glycol fluid can be delivered back to the holding tank 517. A rig heat exchange fan 521 can then be utilized so as to pass heat, by forced-air action, into the rig. As such, the present invention is able to deliver heat in a very efficient and effective manner to the drilling rig. The heat should be delivered to the drilling ring in cold weather conditions. In hot weather conditions, the heat can be simply vented through the baffles 505 to the atmosphere.

The present invention allows the assembly, disassembly, loading, moving, and unloading of a complete drilling machine, drilling rig or its individual modules in order to form a stacked plural interconnected master module formed by a forklift or front end loader. This type of drilling system is more efficient, consumes less location space, it is safer because there is less than human contact with packages, modules, and equipment during rig-up and rig-down operations.

The drilling system of the present invention is made up with the modules for the rig equipment incorporated within the module. These are designed and built as standard DOT loads. When combined with a DOT standard straight truck or truck-and-trailer combination, it will remain as a DOT standard legal load that is able to travel on interstate highways and/or standard-rated roads for twenty-four hours a day seven days a week.

The primary rig engine radiator (waste heat recovery system) is designed to heat or cool the majority of or a portion of the modules that make up the drilling rig. Intermittent waste heat is generated when a hoist or drawworks electric motor is used to brake or stop loads. This intermittent energy is utilized in assisting the heating of the drilling rig or its modules through its engine radiator module and/or by preheating the rig gas/diesel-fired boiler fluids, and/or by preheating a rig gas/diesel fired forced air heater.

The drilling system of the present invention is formed of modules or packages that are stacked to form one master module. This serves to reduce location space, to minimize loads, weights and sizes, to reduce moving time while increasing efficiency in loading and unloading. There is also better control of the modules during moves where the crews have less contact with the modules. The modules that are stacked in this former better able to control the working environment and temperature for its rig personnel and equipment.

The ventilation system of the present invention takes the normal drilling rig engine radiator system (i.e. heat recovery system) and modifies it with additional features to be more efficient and productive. It takes an engine primary radiator structure module having internal fluid cooling coils and a fan with an electric motor and adds an electric resistor bank, adds additional air intake and output openings, and includes internal air diverter device. When the engine is running and/or the drawworks motor is generating intermittent energy, the ventilation system of the present invention will pass air through the engine fluid coils and that over the drawworks waste heat electric resistor bank to pick up the heat to disperse into the atmosphere or into the interior of the drilling rig. If the engine is not running on the drawworks motor is not generating energy, the ventilation system of the present invention will move fresh ambient air to the interior of the rig modules or remove air or gases from the interior modules by the air diverter systems. The incoming cool air source will come from the engine compartment, outside atmosphere, and from the interior of the rig modules, while its air exhaust exits to the atmosphere or to the interior of the rig modules. The ventilation system serves to deliver heated or cooled air to the atmosphere or the interior of the rig. The flow of air comes through openings and the diverters direct air to areas depending on the rig requirements, temperature, and decision of the driller.

The present invention provides the moving of a small single joint or multi-joints ranging from two feet to ninety feet in length. This can include drill pipe, subs, tubes, drill collars, and casings. These are moved from a horizontal pipe rack to and from a vertical mast or drilling string. The present invention utilizes a multi-expandable pipe boom capable of handling single or multiple joints of drill pipe, subs, drill collars, tubes or casing. There is also a coupling or decoupling since the system to connect or brake multi-joints on the horizontal level. This works in conjunction with the automatic pipe racking system.

The foregoing disclosure and description of the invention is illustrative and explanatory thereof. Various changes in the details of the illustrated configuration can be made within the scope of the appended claims without departing from the true spirit of the invention. The present invention should only be limited by the following claims and their legal equivalents.

We claim:

1. A drilling system for use at a wellhead, the drilling system comprising:

a plurality of modules each containing a rig component therein, said plurality of modules being connected or interconnected together so as to form a drilling rig, each of said plurality of modules having a size adapted to be lifted by a forklift or a front end loader, said plurality of modules being arranged such that one end of said plurality of modules is adjacent to the wellhead, each of said plurality of modules having a pair of fork pockets thereon, the pair of fork pockets adapted to receive forks of the forklift therein;

a pipe handling system positioned adjacent to said one end of said plurality of modules, said pipe handling system positioned on a side of the wellhead opposite at least some of said plurality of modules, said pipe handling system comprising:

a pipe rack adapted to received a pipe thereon, said pipe rack extending in longitudinal alignment with said plurality of modules;

a base having a plurality of sections telescopically connected together so as to be movable between a retracted position and an extended position; and a plurality of supports extending upwardly from said base, each of said plurality of supports having a pipe-receiving cradle at an end opposite said base.

2. The drilling system of claim 1, said pipe handling system further comprising:

a lifting boom cooperative with said pipe rack and adapted to move the pipe from a horizontal orientation on said pipe rack to a vertical orientation above the wellhead.

3. The drilling system of claim 2, said lifting boom being pivotally mounted with respect to said pipe rack, said lifting boom having clamps thereon adapted to grip the pipe, the pipe handling system further comprising:

an actuator connected to said lifting boom so as to pivot said lifting boom from a horizontal orientation to a vertical orientation.

4. The drilling system of claim 2, one of said plurality of modules having a mast extending vertically upwardly therefrom, said mast receiving the pipe when the pipe is in the vertical orientation.

5. The drilling system of claim 2, said lifting boom comprising a plurality of sections telescopically connected so as to move said lifting boom from a retracted position to an extended position.

6. The drilling system of claim 5, said extended position adapted to receive pipe having a length of 90 feet, said retracted position having a length adapted to be transported on a bed of a truck.

7. The drilling system of claim 1, one of said plurality of modules having an engine therein, the drilling system further comprising:

a ventilation system cooperative with said plurality of modules so as to move air toward or away from said engine in said one of said plurality of modules.

8. The drilling system of claim 7, said ventilation system selectively opening to an ambient environment exterior of said plurality of modules, said ventilation system selectively venting air from said one of said plurality of modules to the ambient environment.

9. The drilling system of claim 8, said ventilation system selectively opening so as to draw air from said ambient environment so as to pass into said plurality of modules.

10. The drilling system of claim 9, another of said plurality of modules having a drawworks therein, said ventilation system cooperative with said another of said plurality of modules so as to move air toward or away from said drawworks.

11. The drilling system of claim 1, said plurality of modules comprising:

a first array of modules positioned on an underlying surface;

a second array of modules positioned on top of said first array of modules; and a third array of modules positioned on top of said second array of modules.

12. The drilling system of claim 11, each of said first, second and third arrays of modules having a generally rectangular configuration.

13. A drilling system for use at a wellhead, the drilling system comprising:

a plurality of modules each containing a rig component, said plurality of modules being connected or interconnected together so as to form a drilling rig, each of said plurality of modules having a size adapted to be lifted by a forklift or a front end loader; and a pipe handling system positioned adjacent to one end of said plurality of modules, said pipe handling system comprising:

a base having a plurality of sections telescopically connected together so as to be movable between a retracted position and an extended position; and a plurality of supports extending upwardly from said base, each of said plurality of supports having a pipe-receiving cradle at an end opposite said base.

14. The drilling system of claim 13, said plurality of modules being arranged such that said one end of said plurality of modules is adjacent to the wellhead.

15. The drilling system of claim 14, said pipe rack extending in longitudinal alignment with said plurality of modules; and a lifting boom cooperative with said pipe rack and adapted to move the pipe from a horizontal orientation on said pipe rack to a vertical orientation above the wellhead.

16. The drilling system of claim 15, said lifting boom comprising at least three sections telescopically connected so as to move said lifting boom from a retracted position to an extended position, said extended position adapted to receive pipe having a length of ninety feet, said retracted position having a length adapted to be transported on a bed of a truck.

* * * * *